US007692825B2

(12) United States Patent
Koga et al.

(10) Patent No.: US 7,692,825 B2
(45) Date of Patent: Apr. 6, 2010

(54) SHEET SUPPLYING APPARATUS AND IMAGE RECORDING APPARATUS INCLUDING SAME

(75) Inventors: Yuji Koga, Nagoya (JP); Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 888 days.

(21) Appl. No.: 11/468,965

(22) Filed: Aug. 31, 2006

(65) Prior Publication Data

US 2007/0081199 A1 Apr. 12, 2007

(30) Foreign Application Priority Data

Aug. 31, 2005 (JP) ..... 2005-252736

(51) Int. Cl.
*B65H 5/22* (2006.01)
*H04N 1/04* (2006.01)

(52) U.S. Cl. ..... 358/496; 271/3.14; 358/498

(58) Field of Classification Search ..... 358/46, 358/47, 48, 498; 355/23, 26, 48; 399/361, 399/363, 364, 365; 271/3.05, 3, 3.14, 8.1, 271/9.02, 291

See application file for complete search history.

(56) References Cited

U.S. PATENT DOCUMENTS 6,244,588 B1 6/2001 Tsubakimoto et al.

(Continued)

FOREIGN PATENT DOCUMENTS

JP 410203684 * 8/1998

(Continued)

OTHER PUBLICATIONS

European Patent Office, European Search Report for Related Application No. EP 06018028.8 dated Dec. 13, 2006.

*Primary Examiner*—Jerome Grant, II
(74) *Attorney, Agent, or Firm*—Baker Botts L.L.P.

(57) ABSTRACT

A sheet supplying apparatus, comprising a sheet accommodating portion which accommodates stacked recording sheets such that the recording sheets are supported by a support surface thereof; a sheet supplying arm which is supported by a frame such that the sheet supplying arm is pivotable about a first axis line, and which is biased toward the support surface of the sheet accommodating portion; a sheet supplying roller which is supported by an end portion of the sheet supplying arm such that the sheet supplying roller is rotatable about a second axis line parallel to the first axis line, and which is pressed on the uppermost recording sheet, so that when the sheet-supply roller is rotated, the uppermost recording sheet is supplied from the sheet accommodating portion; a receiving portion which is provided in the support surface and which is covered by the recording sheets and is opened when a trailing end of the last recording sheet passes over the receiving portion; and a moving device including a detecting portion which is supported by the recording sheets and which moves, when the trailing end of the last recording sheet passes over the receiving portion, into the receiving portion, and further including a detection-movement converting device which converts the movement of the detecting portion into the receiving portion, into the pivotal movement of the sheet supplying arm about the first axis line in a direction to move the sheet supplying roller away from the support surface of the sheet accommodating portion.

16 Claims, 20 Drawing Sheets

U.S. PATENT DOCUMENTS

| | | | | |
|---|---|---|---|---|
| 6,382,620 | B1 | 5/2002 | Gaarder et al. | |
| 2002/0050677 | A1* | 5/2002 | Sato et al. | 270/58.08 |
| 2002/0074710 | A1* | 6/2002 | Sheng et al. | 271/109 |
| 2002/0084574 | A1 | 7/2002 | Kim | |
| 2003/0202218 | A1* | 10/2003 | Morinaga et al. | 358/474 |
| 2004/0012139 | A1 | 1/2004 | Asada et al. | |
| 2005/0001371 | A1 | 1/2005 | Otsuki | |
| 2007/0057427 | A1* | 3/2007 | Kamiya et al. | 270/58.12 |

FOREIGN PATENT DOCUMENTS

| | | | |
|---|---|---|---|
| JP | 2001-058740 | A | 3/2001 |
| JP | 2002249248 | | 9/2002 |
| JP | 200381468 | | 3/2003 |
| JP | 2004338905 | | 12/2004 |

* cited by examiner

SHEET SUPPLYING APPARATUS AND IMAGE RECORDING APPARATUS INCLUDING SAME

The present application is based on Japanese Patent Application No. 2005-252736 filed on Aug. 31, 2005, the contents of which are incorporated herein by reference.

BACKGROUND OF THE INVENTION

1. Field of the Invention

The present invention relates to a sheet supplying apparatus that supplies a plurality of recording sheets, one by one, to an image recording portion, and an image recording apparatus including the sheet supplying apparatus and the image recording portion.

2. Discussion of Related Art

There is known a sheet supplying device for use in, e.g., an ink-jet recording apparatus. The sheet supplying device supplies a plurality of recording sheets, one by one, to an image recording portion of the ink-jet recording apparatus. The sheet supplying device includes an arm member that is connected, at a base end portion thereof, to a frame of the recording apparatus such that the arm member is pivotable about an axis line. The plurality of recording sheets are stacked on each other on a sheet supporting portion such as a bottom plate of a sheet-supply cassette that opens upward. The arm member is biased downward by a biasing force of a spring, and accordingly a sheet-supply roller supported by a free end portion of the arm member is pressed on the uppermost one of the recording sheets. When the sheet-supply roller is rotated, the uppermost recording sheet is moved relative to the remaining recording sheets, so that a leading end of the uppermost sheet engages an inclined sheet-separate plate provided at a downstream-side end of the sheet supporting portion with respect to a direction of moving of recording sheet. Thus, only the uppermost recording sheet is separated from the other recording sheets remaining on the sheet supporting portion, and is supplied to the image recording portion so that the recording sheet is opposed to the same. This sheet supplying device is disclosed by, e.g., Patent Document 1 (Japanese Patent Application Publication No. 2002-249248) or Patent Document 2 (Japanese Patent Application Publication No. 2004-338905 or its corresponding U.S. Patent Application Publication No. 2005-001371).

In addition, Patent Document 2 teaches that an outer circumferential surface of the sheet-supply roller is formed of a material having a high friction coefficient, such as rubber. Moreover, a portion of the sheet supporting portion that is opposed to the outer circumferential surface of the sheet-supply roller is provided with a material having a high friction coefficient. For example, a cork sheet is adhered to that portion of the sheet supporting portion. Thus, when only a few recording sheets remain on the sheet supporting portion, a frictional resistance is applied to the recording sheet or sheets underlying the uppermost recording sheets, so that the underlying sheet or sheets can be prevented from being supplied with the uppermost sheet directly engaged with the outer circumferential surface of the sheet-supply roller. On the other hand, when no recording sheet remains on the sheet supporting portion, the outer circumferential surface of the sheet-supply roller is pressed on an upper surface of the sheet supporting portion. In this state, if the sheet-supply roller is rotated, then the outer circumferential surface of the roller may be worn excessively. If the frictional force is increased excessively, then the sheet-supply roller may be locked so that a driving system that drives the roller may be broken or an electric motor of the driving system may be seized or stuck. To avoid this problem, Patent Document 2 proposes to form, in the upper surface of the sheet supporting portion, a relief hole that prevents the outer circumferential surface of the sheet-supply roller from contacting the sheet supporting portion.

However, the sheet supplying device disclosed by Patent Document 2 suffers the following drawbacks: When only a few recording sheets remain on the sheet supporting portion and each of the recording sheets is thin, the sheet-support roller may be pressed, by the biasing force of the spring to bias the arm member downward, against the recording sheets, so that the recording sheets may be partly forced into the relief hole. Thus, the recording sheets may be flexed, or wrinkled, along the edges of the relief hole that extend parallel to the direction of moving of recording sheet, or may be jammed because of the shortage of sheet-moving force.

SUMMARY OF THE INVENTION

In the above-described technical background, the present invention has been developed. It is therefore an object of the present invention to solve at least one of the above-indicated problems. It is another object of the present invention to provide a sheet supplying apparatus including a moving device that moves, when no recording sheet remains in a sheet accommodating portion, a sheet supplying roller from a support surface of the sheet accommodating portion. It is another object of the present invention to provide an image recording apparatus including the sheet supplying apparatus.

According to the present invention, there is provided a sheet supplying apparatus, comprising a sheet accommodating portion which has a support surface and which accommodates a plurality of stacked recording sheets including an uppermost recording sheet, such that the recording sheets are supported by the support surface; a frame which supports the sheet accommodating portion; a sheet supplying arm which is supported by the frame such that the sheet supplying arm is pivotable about a first axis line, and which is biased toward the support surface of the sheet accommodating portion; at least one sheet supplying roller which is supported by an end portion of the sheet supplying arm such that the at least one sheet supplying roller is rotatable about a second axis line parallel to the first axis line, and which is pressed on the uppermost recording sheet, so that when the at least one sheet-supply roller is rotated, the uppermost recording sheet is supplied from the sheet accommodating portion; a receiving portion which is provided in the support surface of the sheet accommodating portion and which is covered by the recording sheets and is opened when a trailing end of a last one of the recording sheets passes over the receiving portion; and a moving device including a detecting portion which is supported by the recording sheets and which moves, when the trailing end of the last recording sheet passes over the receiving portion, into the receiving portion and thereby detects the passing of the last recording sheet, and further including a detection-movement converting device which converts a movement of the detecting portion into the receiving portion, into a pivotal movement of the sheet supplying arm about the first axis line in a first direction to move the at least one sheet supplying roller away from the support surface of the sheet accommodating portion.

In the present sheet supplying apparatus, the receiving portion is provided in the support surface of the sheet accommodating portion, and is covered by the recording sheets. However, the receiving portion is opened when the trailing end of the last recording sheet passes over the receiving portion. In addition, the moving device includes the detecting portion which is supported by the recording sheets and which moves, when the trailing end of the last recording sheet passes over the receiving portion, into the receiving portion and thereby detects the passing of the last recording sheet, and additionally includes the detection-movement converting device which converts the movement of the detecting portion into the receiving portion, into the pivotal movement of the sheet supplying arm about the first axis line in the first direction to move the at least one sheet supplying roller away from the support surface of the sheet accommodating portion. Therefore, when no recording sheets remain on the support surface of the sheet accommodating portion, no friction forces are produced between the sheet supplying roller and the support surface of the sheet rotated in a forward direction, i.e., a sheet-supply direction. Thus, an outer circumferential surface of the sheet supplying roller can be prevented from being excessively worn, and the rotation of the roller can be prevented from being stopped, i.e., "locked". Therefore, a driving source can be prevented from being seized or stuck because of the application of excessively large loads thereto.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

Figure 1:
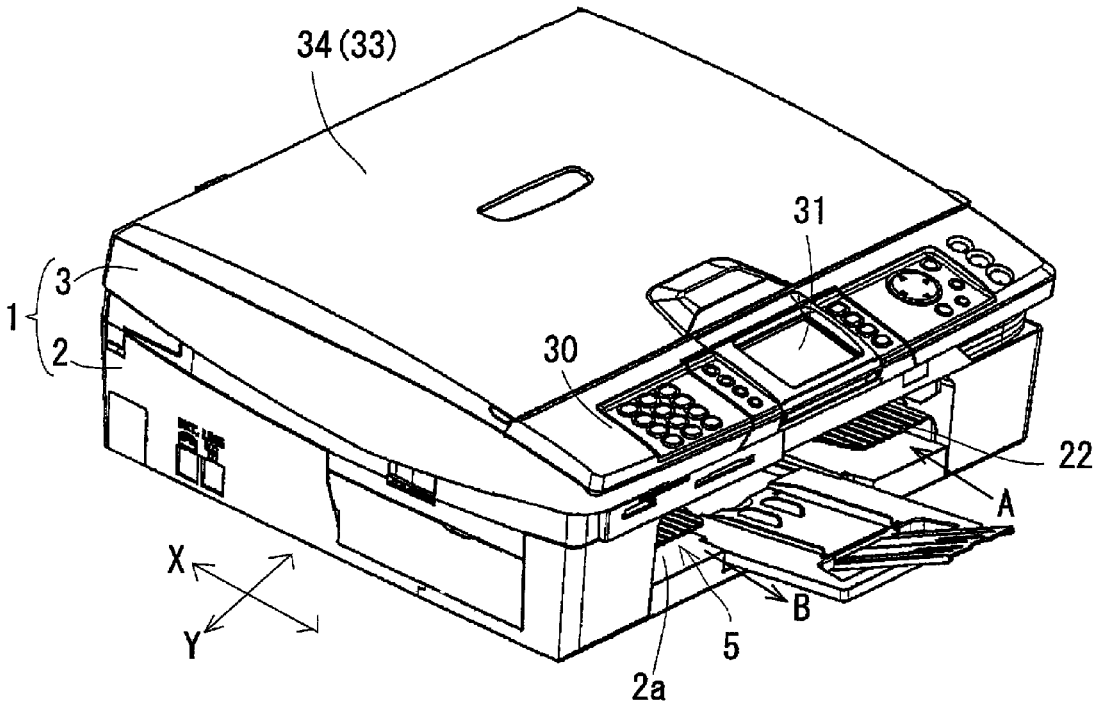
FIG. 1 is a perspective front view of an image recording apparatus as a first embodiment of the present invention.

FIG. 1 shows an image recording apparatus 1 to which the present invention is applied. The image recording apparatus 1 is a so-called "multi-function device (MFD)" that has a printer function, a copier function, a scanner function, and a facsimile-machine function. As shown in the figure, the image recording apparatus 1 includes a main case 2 as a main frame that has a generally box-like configuration opening upward; and an upper case 3 that is connected to one side (i.e., left-hand side in FIG. 1) of the main case 2 via pivot-axis portions such as hinges such that the upper case 3 is pivotable upward and downward relative to the main case 2. Each of the main case 2 and the upper case 3 is formed by injection molding of a synthetic resin. In FIG. 1, an arrow "X" indicates an X-axis direction, i.e., a sub-scan direction; and an arrow "Y" indicates a Y-axis direction, i.e., a main scan direction that is perpendicular to the X-axis direction or the sub-scan direction.

In the top and front portion of the upper case 3, an operation panel 30 is provided. The operation panel 30 includes various sorts of operation keys, such as numeral keys, a start key, and function keys, each of which is manually operable by a user to input various commands and data. The operation panel 30 additionally includes a display 31 such as a liquid crystal display (LCD) that displays, as needed, information representing a current status of the image recording apparatus 1, and/or various messages directed to the user.

The upper case 3 incorporates, in rear of the operation panel 30, a scanner device (i.e., an image reading portion) 33 that reads, from an original sheet, an original document or image when the document or image is transmitted, by the facsimile-machine function, to a remote facsimile machine or when the document or image is copied by the copier function. The scanner device 33 includes a so-called "flat-bed" reading portion that reads an image from an original sheet placed on a large-size glass plate; and a pivotable cover member 34 that covers an upper surface of the flat-bed reading portion.

Right below the glass plate of the flat-bed reading portion, a line-type contact image sensor (CIS, not shown) as a sort of a photoelectric transducer that reads the image from the original sheet placed on the glass plate is provided such that the CIS can be reciprocated along a guide member extending in the main scan direction, i.e., the Y-axis direction in which a carriage 13, described later, is moved.

The cover member 34 is connected, at a rear side thereof, to a rear side of the upper case 3 via hinges, such that the cover member 13 is pivotable upward and downward about the hinges. The user can open the cover member 34 by pivoting the same 13 upward, place the original sheet on the upper surface of the glass plate, and close the same 3 by pivoting it downward.

Relative to the main case 2, the upper case 3 can be largely opened, i.e., pivoted upward about the left-hand side of the main case 2 (FIG. 1). This opened posture of the upper case 2 is maintained by an opened-posture maintaining device, not shown.

Next, there will be described a construction of a printer device (i.e., an image recording portion). As shown in FIG. 1, the main case 2 accommodates, in a central portion thereof, a sheet-supply cassette 5 as a sheet accommodating portion that holds, on a bottom surface 5*a* (FIG. 3) thereof as a support surface thereof, a plurality of recording sheets P such that the recording sheets P are stacked on each other on the bottom surface 5*a* and each recording sheet P takes a substantially horizontal posture. The sheet-supply cassette 5 can be inserted to, and removed from, the main case 2 through an opening 2*a* provided in a front surface of the same 2.

In addition, the main case 2 incorporates, above the sheet-supply cassette 5, a sheet-supply unit 6 that includes two sheet-supply rollers 7; a sheet-feed path along which each recording sheet P is fed and which has, at a rear end of an inner space of the main case 2, a U-shaped portion 9 where the direction of feeding of recording sheet P is changed from an upward direction to a horizontal and frontward direction; and a recording unit 10 including a flat platen 11 that is provided in an intermediate portion of the sheet-feed path, and an ink-jet recording head 12 that ejects droplets of inks toward an upper surface of the recording sheet P supported on the platen 11 so as to record an image on the sheet P. The sheet-supply cassette 5 and the sheet-supply unit 6 cooperate with each other to provide a sheet supplying apparatus to which the present invention is applied.

The recording head 12 records a full-color image on the recording sheet P. To this end, four ink cartridges 26 supply respective different inks to the recording head 12. Each of the ink cartridges 26 is detachably attached to a cartridge-support portion 27 (FIG. 2) through the upper opening of the main case 2. The cartridge-support portion 27 is provided at a location adjacent to an inner surface of a side wall of the main case 2 that is opposite to, and remote from, the side wall thereof having the above-described pivot-axis portions. In the present embodiment, the above-indicated four different inks are a black ink, a cyan ink, a magenta ink, and a yellow ink. However, one or more different inks may be used. The four ink cartridges 26 supply the respective inks to the recording head 12 via respective flexible tubes 28.

Figure 2:
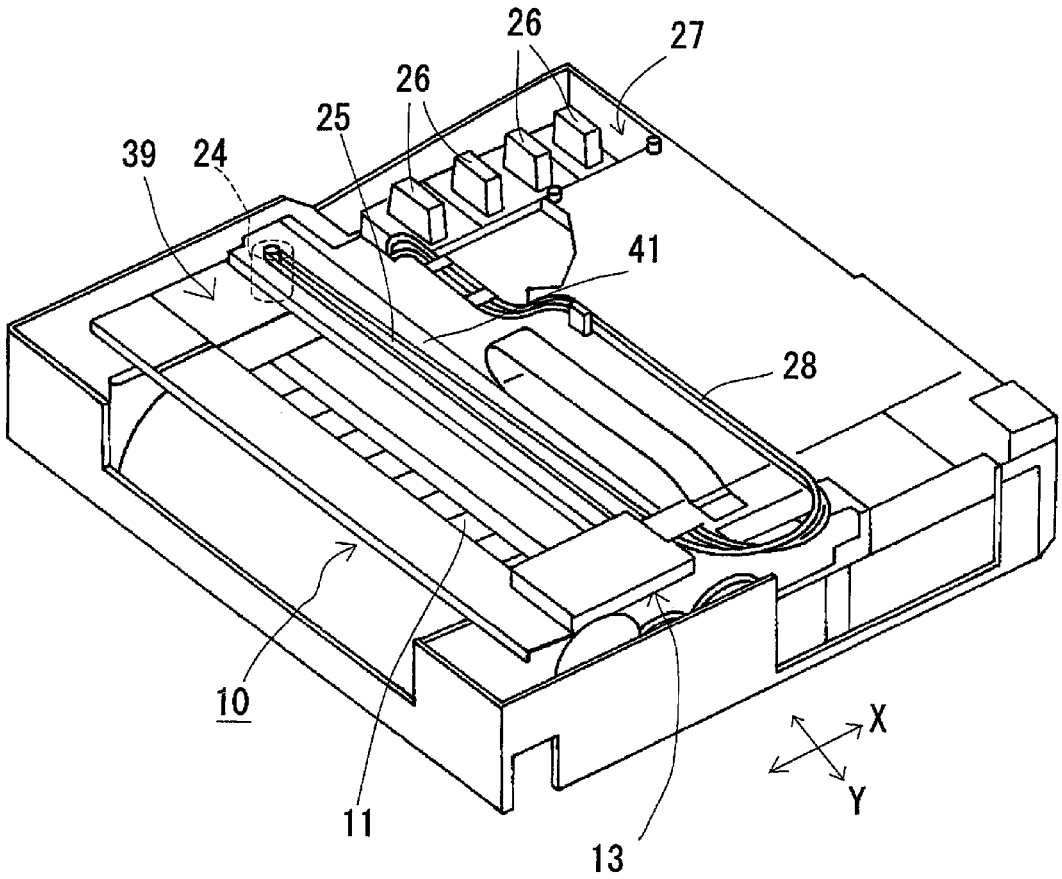
FIG. 2 is a perspective rear view of a main case of the image recording apparatus in a state in which an upper case thereof is removed.
Figure 3:
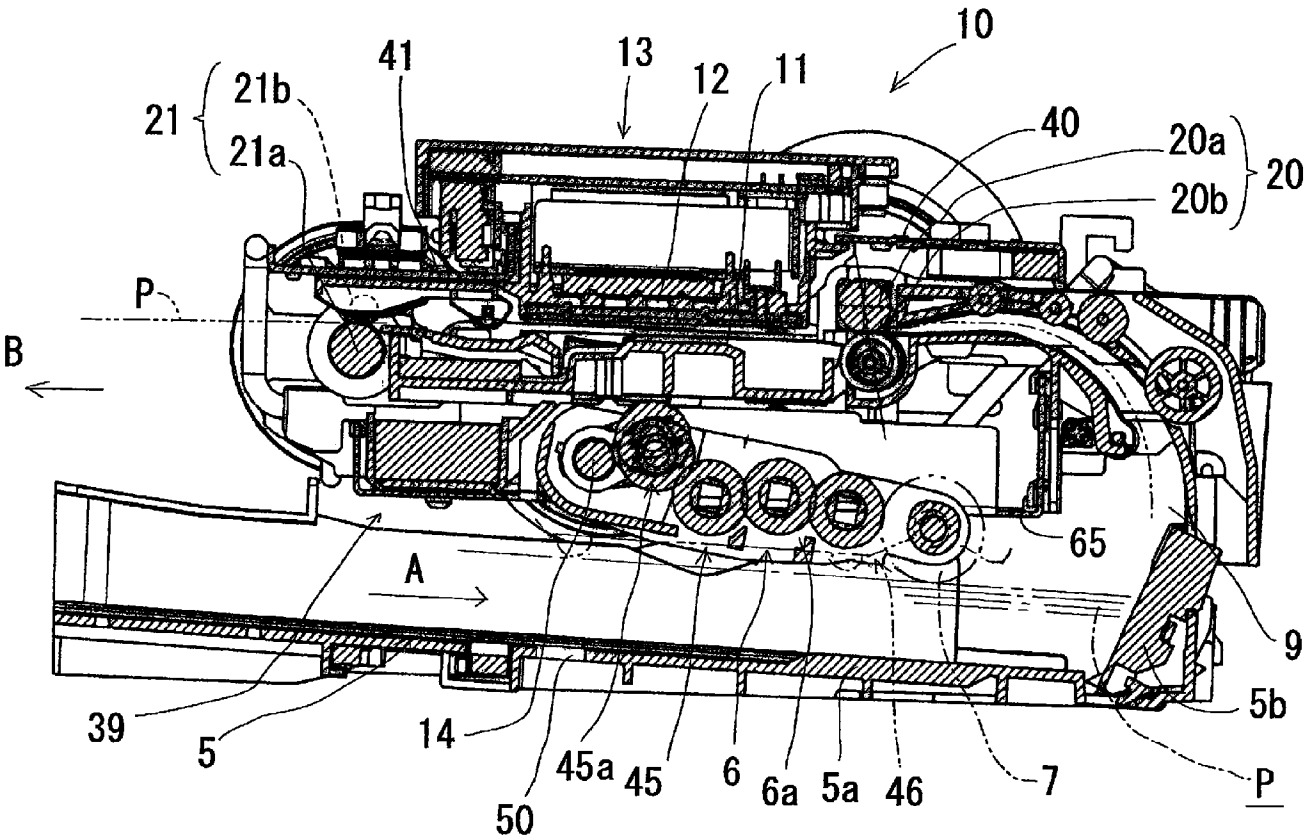
FIG. 3 is a cross-section view of the image recording apparatus, taken along a plane perpendicular to a Y direction in FIG. 1, in a state in which a sheet-supply cassette is inserted in the main case.
Figure 4:
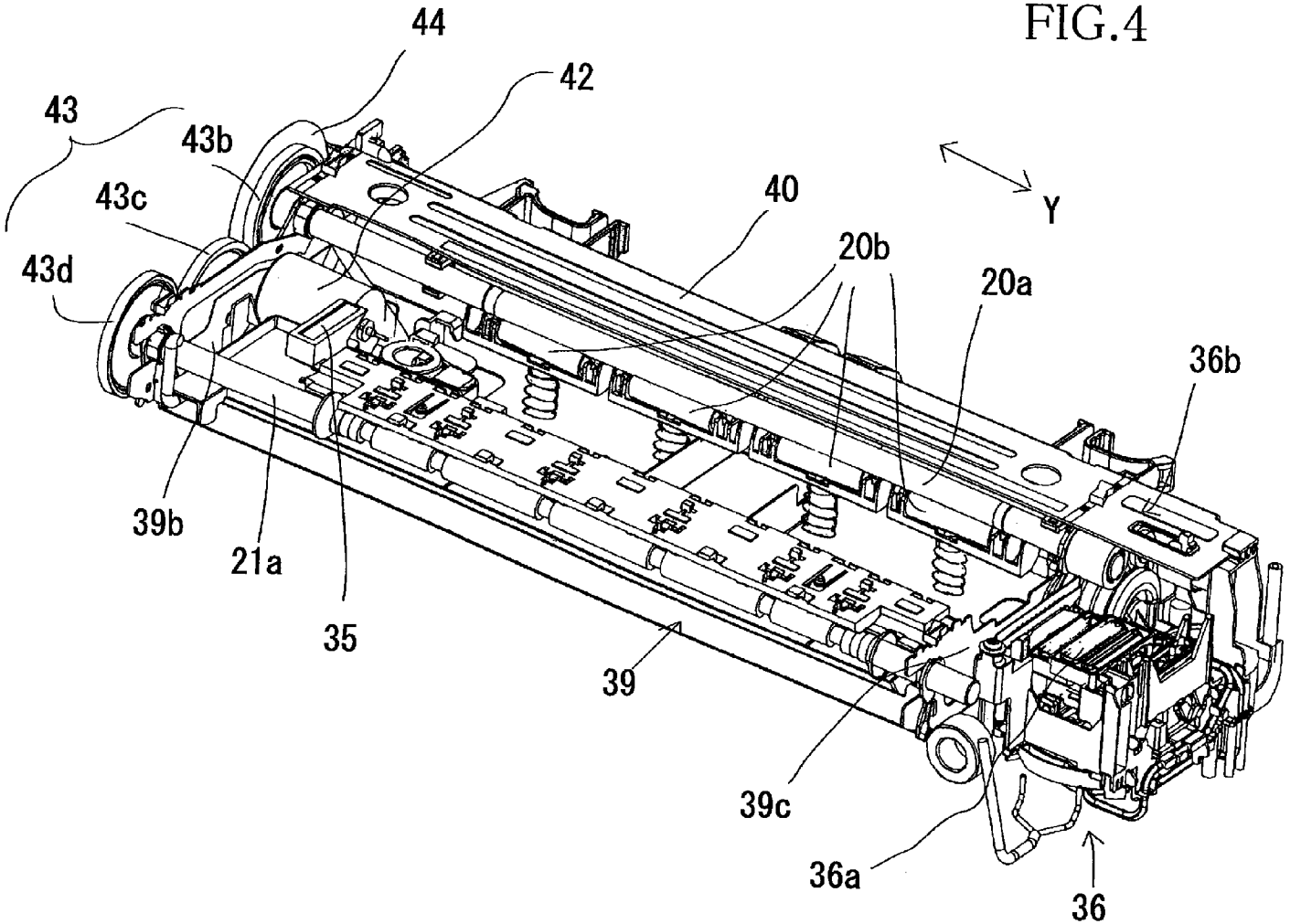
FIG. 4 is a perspective view of an image recording portion in a state in which a downstream-side one of two guide plates is removed.

As shown in FIGS. 2, 3, and 4, the recording unit 10 is essentially constituted by the carriage 13 carrying the recording head 12; the plate-like platen 11 that is formed of a synthetic resin; a CR (carriage) motor 24 that reciprocates the carriage 13; a timing belt 25 which is driven by the CR motor 24 and to which the carriage 13 is connected; and an engine frame 39 that is formed of a metal plate and that supports the elements 13, 11, 24, 25. However, the platen 11 is not shown in FIG. 4. The main case 2 as the main frame cooperates with the engine frame 39 to provide a frame of the sheet supplying apparatus. The engine frame 39 is provided in a rear portion of the main case 2, and above the sheet-supply cassette 5 inserted in the same 2. More specifically described, the engine frame 39 is provided in an upper portion of the box-like main case 2 such that the frame 39 extends in the main scan direction or the Y-axis direction. To the engine frame 39, a pair of guide plates 40, 41 are attached. The two guide plates 40, 41 cooperate with each other to support the carriage 13 such that the carriage 3 is movable thereon. A downstream-side one 41 of the two guide plates 40, 41 in a direction of feeding of recording sheet P is provided with a belt-like linear encoder (i.e., an encoder strip, not shown) such that the linear encoder extends parallel to a lengthwise direction of the guide plate 41, i.e., the main scan direction. The linear encoder detects a current position of the carriage 13 in the Y-axis direction (i.e., the main scan direction). The belt-like linear encoder (the encoder strip) has, in a detection portion thereof, a plurality of slits formed at a regular pitch in the Y-axis direction, and is disposed such that the detection portion is vertical.

The engine frame 39 supports a drive axis member 14 about which an arm member 6*a* of the sheet-supply unit 6 is freely rotatable, and additionally supports the plate-like platen 11 that is opposed to a lower surface of the recording head 12 while supporting the recording sheet P. The arm member 6*a* is biased by a torsion spring 6*b* (FIGS. 5A, 5B, and 5C) in a downward direction about the drive axis member 14. The arm member 6*a* supports a gear transmission device 45 including a planetary gear 45*a* that revolves about the drive axis member 14. When the drive axis member 14 is rotated clockwise as seen in FIG. 3, the planetary gear 45*a* is engaged with an adjacent gear of the gear transmission device 45 so that a rotation of the axis member 14 is transmitted to the sheet-supply rollers 7 via the gear transmission device 45. On the other hand, when the drive axis member 14 is rotated counterclockwise as seen in the figure, the planetary gear 45*a* is disengaged from the adjacent gear so that the rotation of the axis member 14 is not transmitted to the sheet-supply rollers 7 and accordingly the rollers 7 are permitted to rotate freely.

On an upstream side of the flat platen 11 in the direction of feeding of recording sheet P, there are provided a pair of registering (feeding) rollers 20 that include a first drive roller 20*a* and first follower rollers 20*b* and that cooperate with each other to register the recording sheet P, nip the same P, and feed the same P to the recording head 12 so that the head 12 records an image on the same P. In addition, on a downstream side of the flat platen 11 in the feeding direction, there are provided a pair of discharging rollers 21 that include a second drive roller 21*a* and second follower rollers 21*b* and that cooperate with each other to nip the recording sheet P on which the image has been recorded by the recording head 12 and discharge the same P, in a direction "B" shown in FIGS. 1 and 3, onto a sheet-discharge portion 22. The engine frame 39 includes two side plates 39*b*, 39*c* having respective support portions that support respective opposite end portions of the first drive roller 20*a* of the registering rollers 20 and respective opposite end portions of the second drive roller 21*a* of the discharging rollers 21, such that each of the two drive rollers 20*a*, 21*a* is rotatable. The first drive roller 20*a* is provided above the first follower rollers 20*b*; and the second drive roller 21*a* is provided below the second follower rollers 21*b*. The second follower rollers 21*b* are a spur roller.

Each of the first drive roller 20*a*, the second drive roller 21*a*, and a maintenance portion 36 receives a drive power from a LF (line-feed) motor (i.e., a sheet-feed motor) 42 as an electric motor via a gear transmission device 43, as shown in FIG. 4. The LF motor 42 is rotatable in each of opposite directions, i.e., a forward and a backward direction, and is provided in the vicinity of the first side plate 39*b* opposite to the second side plate 39*c* in the vicinity of which the maintenance portion 36 is provided. The gear transmission device 43 includes a pinion, not shown, that is connected to an output shaft of the LF motor 42; a first transmission gear 43*b* and an intermediate gear 43*c* that are meshed with the pinion on either side thereof; and a second transmission gear 43*d* that is meshed with the intermediate gear 43*c*. The first transmission gear 43*b* is connected to one (i.e., left-hand one) of the opposite end portions of the first drive roller 20*a*; and the second transmission gear 43*d* is connected to one (i.e., left-hand one) of the opposite end portions of the second drive roller 21*a*.

In the present embodiment, a drive power, i.e., rotation of the LF motor 42 is transmitted from the other end (i.e., right-hand end) of the first drive roller 20*a* to the sheet-supply unit 6 via a drive-power switching portion 36*b* of the maintenance portion 36.

In the present embodiment, since the first drive roller 20*a* and the second drive roller 21*a* are provided on an upper side and a lower side of the sheet-feed path, respectively, as described above, the two drive rollers 20*a*, 21*a* are rotated in opposite directions when the LF motor 42 is rotated in one direction.

The first transmission gear 43*b* is provided with a rotary encoder 44 that detects an amount of feeding of the recording sheet P by the first drive roller 20*a*. Like the LF motor 42, the CR motor 24 is rotatable in each of a forward direction and a backward direction.

When the sheet-supply unit 6 supplies, from the sheet-supply cassette 5, the recording sheets P, one by one, in a direction "A" shown in FIGS. 1 and 3, the LF motor 42 is rotated in the backward direction, so that the drive axis member 14 is rotated clockwise in FIG. 3, i.e., in a forward direction via the maintenance portion 36, described later. Since the arm member 6*a* is elastically biased downward by the torsion spring 6*b*, the sheet-supply rollers 7 provided at the lower end of the arm member 6*a* are pressed on the uppermost one of the recording sheets P accommodated in the sheet-supply cassette 5. In this state, the sheet-supply rollers 7 are rotated counterclockwise as seen in FIG. 3, i.e., in a sheet-supply direction via the gear transmission device 45 supported by the arm member 6*a*.

When a recording sheet P is not supplied from the sheet-supply cassette 5, the LF motor 42 is rotated in the forward direction and accordingly the drive axis member 14 is rotated in a backward direction, so that the planetary gear 45*a* is disengaged from the other gears of the gear transmission device 45 and the rotation of the axis member 14 is not transmitted to the sheet-supply rollers 7, i.e., the rollers 7 are permitted to rotate freely.

Outside the width (i.e., short side) of recording sheet P, there are provided an ink-receive portion 35 at a position near the left-hand side plate 39*b* as seen from a central, main portion of the engine frame 39 in FIG. 4, and a maintenance unit as the maintenance portion 36 at a position near the right-hand side plate 39*c* in FIG. 4. The ink-receive portion 35 has a flushing position where, during a recording operation, the recording head 12 periodically ejects or flushes the inks so as to prevent clogging of ink-ejection nozzles of the recording head 12. The inks ejected by the nozzles of the recording head 12 are received by the ink-receive portion 35.

The carriage 13 has, as an origin or home position thereof, a right-hand end of a carriage-movement range extending in the main scan direction (i.e., the Y direction) as seen in FIG. 4. A position distant by a predetermined distance from the home position in the leftward direction is used as not only a waiting position but also a maintenance position. At the maintenance position, a capping portion 36*a* of the maintenance portion 36 can cover or cap the lower surface of the recording head 12. The maintenance portion 36 includes a vacuum pump (not shown) that is driven by the LF motor 42 so as to carry out a recovering operation in which deteriorated inks are selectively sucked from the nozzles of the recording head 12 and/or air bubbles are removed from buffer tanks (not shown) of the head 12. When the carriage 13 is moved in the leftward direction from the maintenance portion 36 toward an image recording area in which an image is recorded by the recording head 12, a cleaner member (not shown), such as a wiper blade, wipes and cleans the lower surface of the head 12 where the nozzles open.

Next, there will be described a construction of a moving device 46 that moves, when the last recording sheet P is supplied from the sheet-supply cassette 5 and no recording sheet P is left in the cassette 5, the two sheet-supply rollers 7 in an upward direction away from the bottom surface 5*a* of the cassette 5, by reference to FIGS. 5A through 5C and FIG. 6. Respective outer circumferential surfaces of the two sheet-supply rollers 7 are formed of a material having a high friction coefficient, such as rubber. The bottom surface 5*a* of the sheet-supply cassette 5 has two base pads 63 that are fixed to respective portions of the surface 5*a* that are opposed to the two sheet-supply rollers 7 and are formed of a material having a high friction coefficient, such as cork.

The moving device 46 includes a support axis member 47 that supports the two sheet-supply rollers 7 at the lower end of the arm member 6*a*; an operative member 48 which includes two base end portions 48*a* (FIG. 6) that are connected to the support axis member 47 such that the operative member 48 is pivotable about the axis member 47, and which extends upstream with respect to the sheet-supply direction; a detecting portion 49 which is provided on a lower surface of an extending portion of the operative member 48 that extends upward from the base end portions 48*a* and which contacts an upper surface of the uppermost recording sheet P and moves, when the last recording sheet P is supplied from the sheet-supply cassette 5, into a receiving hole 50 as a receiving portion that is formed through a thickness of the bottom wall or plate of the cassette 5; and a fulcrum portion 51 that is provided between the support axis member 47 or the base end portions 48*a*, and the detecting portion 49 and that can contact, when the detecting portion 49 moves into the receiving hole 50, the last recording sheet P or the upper surface of the bottom surface 5*a* of the cassette 5, so that the operative member 48 is pivoted about the fulcrum portion 51 so as to lift the sheet-supply rollers 7 upward away from the bottom surface 5*a*. A sum of (a) a weight of an upstream-side portion 48*c* of the operative member 48 that is located on the upstream side of the fulcrum portion 51, and (b) a weight of the detecting portion 49 is considerably greater than a weight of a downstream-side portion 48*d* of the operative member 48 that is located on a downstream side of the fulcrum portion 51 and is connected to the base end portions 48*a*. That is, the sum of the weight of the upstream-side portion 48*c* of the operative member 48 and the weight of the detecting portion 49 is so predetermined that when no recording sheet P remains on the bottom surface 5*a*, the detecting portion 49 moves into the receiving hole 50, the fulcrum portion 51 first contacts the last recording sheet P and then contacts the bottom surface 5*a*, the operative member 48 is pivoted, owing to the sum of the weights, about the fulcrum portion 51, the arm member 6*a* is pivoted about the drive axis member 14 in the upward direction, and the sheet-supply rollers 7 are lifted upward away from the bottom surface 5*a*. In this connection, a biasing force of the torsion spring 6*b* that biases the arm member 6*a* downward, and respective weights of the arm member 6*a*, the sheet-supply rollers 7, and the support axis member 47 should be taken into consideration. The torsion spring 6*b* may be replaced with a dead weight having an appropriate load. A place where the dead weight is provided depends on a shape and/or a structure of the arm member 6*a*. The dead weight may be replaced with an increased self weight of the sheet-supply arm member 6*a*. Alternatively, two or more of those different biasing means may be combined. These are true with each of the other embodiments, described later. In the present embodiment, the operative member 48 cooperate with gravity as a sort of biasing means to function as a detection-movement converting device which converts the movement of the detecting portion 49 into the receiving hole 50, into the pivotal movement of the sheet-supply arm member 6*a* about the drive axis member 14 in the upward direction so as to move the sheet-supply rollers 7 away from the bottom surface 5*a* of the sheet-supply cassette 5. In the present embodiment, a ratio of a length (as measured in the sheet-supply direction) of the upstream-side portion 48*c* (of the extending portion 48*c*, 48*d*) between the detecting portion 49 and the fulcrum portion 51, to a length (as measured in the same direction) of the downstream-side portion 48*d* (of the extending portion 48*c*, 48*d*) between the fulcrum portion 51 and the base end portions 48*a* (or the support axis member 47) falls in a range of from 5 to 15, more preferably, from 8 to 12. The sheet-supply direction is parallel to the bottom surface 5*a*. The extending portion 48*c*, 48*d* of the operative member 48 extends from the base end portions 48*a* in an obliquely downward direction having a component parallel to a direction opposite to the sheet-supply direction.

Figures 5A, 5B, 5C:
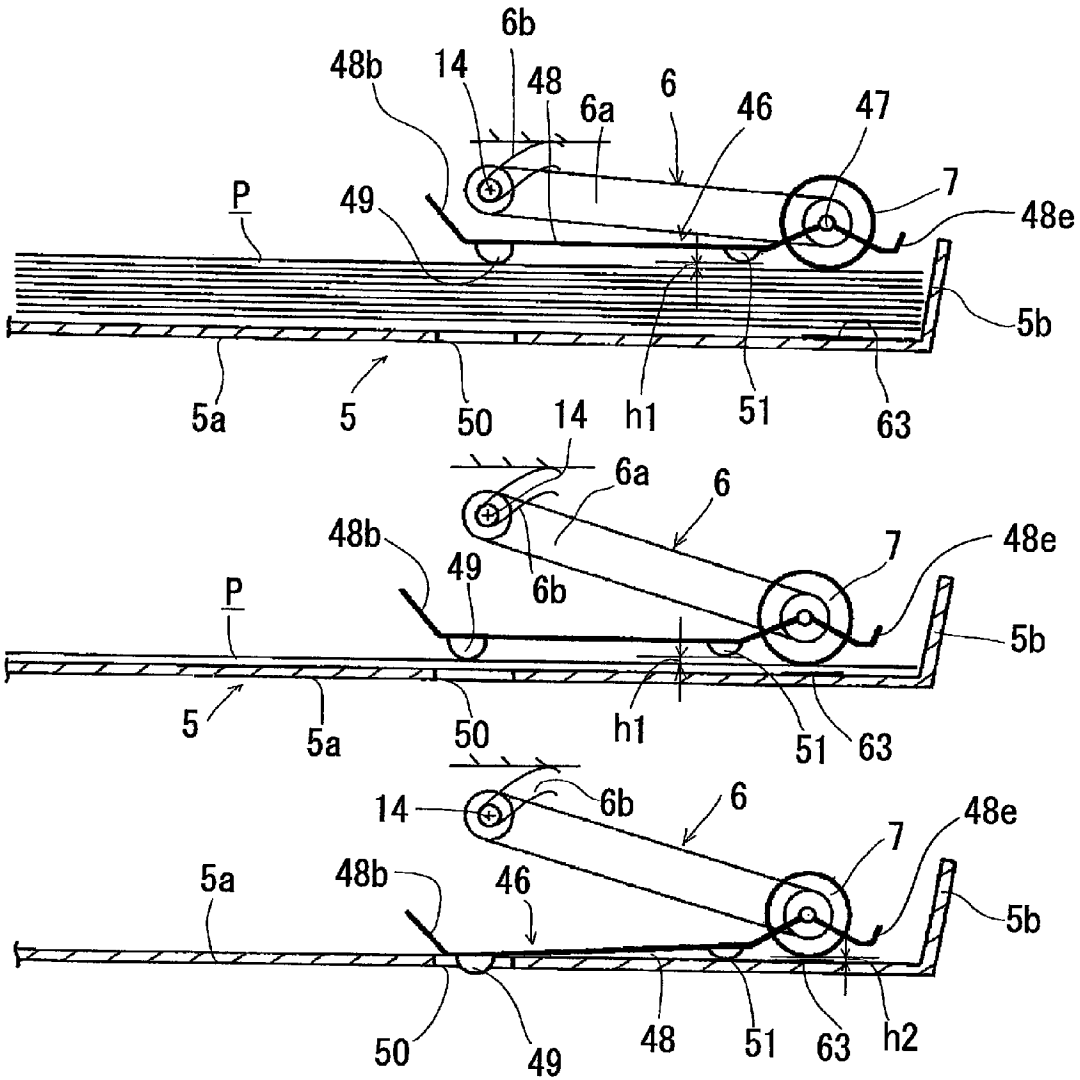
FIG. 5A is a side elevation view showing respective postures of a moving device and a sheet-supply arm member in a state in which many stacked recording sheets P are accommodated in the sheet-supply cassette.
FIG. 5B is a side elevation view showing respective postures of the moving device and the sheet-supply arm member in a state in which the last recording sheet P is left in the sheet-supply cassette.
FIG. 5C is a side elevation view showing respective postures of the moving device and the sheet-supply arm member in a state in which no recording sheet P is left in the sheet-supply cassette.
Figure 6:
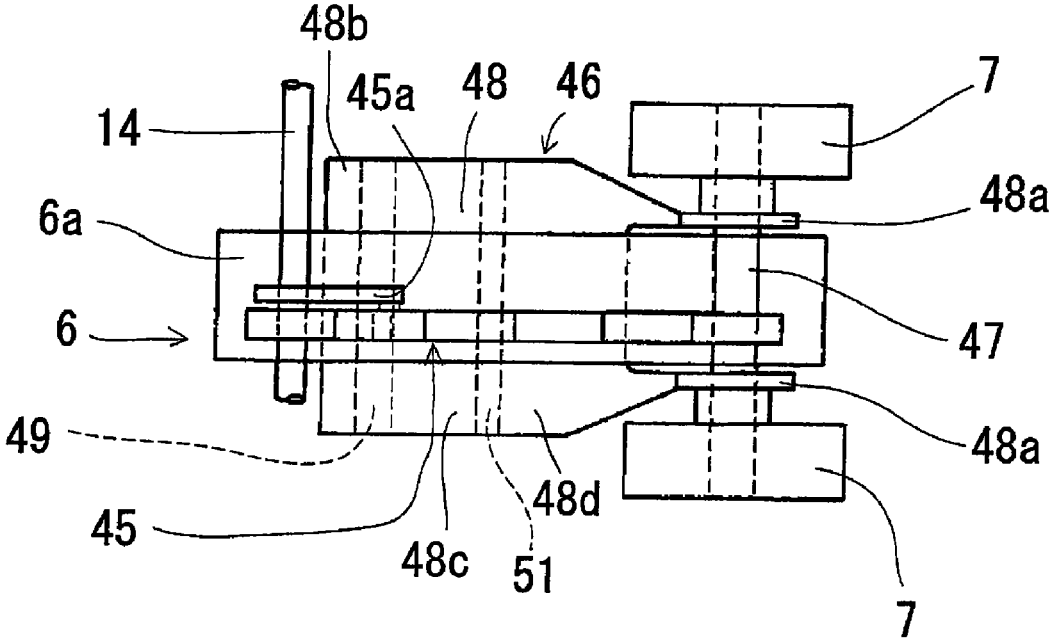
FIG. 6 is a plan view of the moving device and the sheet-supply arm member.

The operative member 48 is formed of a metal plate and has a generally flat shape, as shown in FIG. 6. The two base end portions 48*a* of the operative member 48 include respective flange portions (i.e., pivotal portions) which are provided on either side of the arm member 6*a* and each of which pivotably fits on a portion of the support axis member 47 that is located between the lower end portion of the arm member 6*a* and a corresponding one of the two sheet-supply rollers 7. A portion of the operative member 48 that is located below the arm member 6*a* has a width greater than that of the same 6*a*, as shown in FIG. 6. In addition, the operative member 48 has, on an upstream side of the detecting portion 49, an inclined guide portion 48*b* that is inclined upward and frontward from the detecting portion 49 and that guides respective leading ends of recording sheets P being inserted in the sheet-supply cassette 5. Each of the detecting portion 49 and the fulcrum portion 51 is elongate as shown in FIG. 6, and has a part-cylindrical outer surface as shown in FIGS. 5A through 5C. Thus, a friction produced between (a) the outer surface of each of the detecting portion 49 and the fulcrum portion 51 and (b) the upper surface of each recording sheet P is minimized. In addition, preferably, a sheet having a low friction coefficient is adhered to the outer surface of each of the detecting portion 49 and the fulcrum portion 51. Alternatively, the outer surface of each of detecting portion 49 and the fulcrum portion 51 may be formed of a material having a low friction coefficient. The base end portions 48*a* of the operative member 48 may be pivotably connected to an appropriate portion of the arm member 6*a* other than the support axis member 47, such that the operative member 48 is swingable upward and downward. The fulcrum portion 51 may be provided by one or more rollers that is or are rotatably supported by the operative member 48.

The operative member 48 further includes two engaging portions 48*e* extending from the two base end portions 48*a* downstream in the sheet-supply direction. When the sheet-supply cassette 5 is inserted into the main case 2 and the arm member 6*a* is pivoted about the drive axis member 14 upward to its retracted position by a cam and a cam follower, not shown, the two engaging portions 48*e* of the operative member 48 engage an engaging portion 65 (FIG. 3) of the engine frame 39, so that the extending portion 48*c*, 48*d* of the operative member 48 is pivoted about the base end portions 48*a* upward to its retracted position. In the state in which the arm member 6*a* and the operative member 48 are positioned at the respective retracted positions thereof, the arm member 6*a* and the operative member 48 do not interfere with a leading end portion 5*b* of the cassette 5 being inserted. The two engaging portions 48*e* of the operative member 48 and the engaging portion 65 of the engine frame 39 cooperate with each other to provide a retracting device which retracts the operative member 48 to the retracted position thereof, or a retraction-movement converting device which converts the pivotal movement of the sheet-supply arm member 6*a* to the retracted position thereof, into the pivotal movement of the operative member 48 to the retracted position thereof.

In the present embodiment, in a state in which a plurality of stacked recording sheets P are accommodated in the sheet-supply cassette 5, as shown in FIG. 5A, an angle of inclination of the sheet-supply arm member 6*a*, biased downward by the torsion spring 6*b*, with respect to the horizontal bottom surface 5*a* of the cassette 5 is considerably small, and the sheet-supply rollers 7 are pressed, with an appropriate force, on the uppermost one of the stacked recording sheets P.

Since the operative member 48 is freely pivotable about the support axis member 47 supporting the sheet-supply rollers 7, the detecting portion 49 contacts, owing to its weight, the uppermost recording sheet P, but the fulcrum portion 51 is kept apart from the uppermost recording sheet P by an appropriate distance, h1. In this state, if a sheet-supply command is produced and the drive axis member 14 is rotated in the forward direction, the sheet-supply rollers 7 are rotated counterclockwise in FIG. 5A via the gear transmission device 45, so that a leading end of the uppermost recording sheet P engages an inclined sheet-separate plate provided at the downstream-side end portion 5*b* (i.e., a right-hand end portion as seen in FIG. 3 and FIGS. 5A through 5C) of the sheet-supply cassette 5. The sheet-separate plate has, in a central portion thereof as seen in the widthwise direction of recording sheet P, an elastic sheet-separate pad (e.g., a leaf spring) as a sheet-separate member that separates only the uppermost recording sheet P from the other recording sheet(s) P, and helps the sheet-supply rollers 7 to supply the uppermost recording sheet P only, toward the U-turn portion 9 of the sheet-feed path.

The state shown in FIG. 5A continues till the last recording sheet P is left on the bottom surface 5*a* of the sheet-supply cassette 5, as shown in FIG. 5B. And, when the last recording sheet P is supplied by the sheet-supply rollers 7 and the receiving hole 50 formed in the bottom surface 5*a* is opened, the detecting portion 49 of the operative member 48 moves into the receiving hole 50, and the fulcrum portion 51 contacts the bottom surface 5*a*, the operative member 48 is pivoted about the fulcrum portion 51, owing to the sum of the respective weights of the upstream-side portion 48*c* of the operative portion 48 and the detecting portion 49, so that the downstream-side portion 48*d* and the base end portions 48*a* of the operative portion 48 are moved upward, the arm member 6*a* is also moved upward, and the sheet-supply rollers 7 are moved away from the bottom surface 5*a* by an appropriate distance, h2, as shown in FIG. 5C. Therefore, even if the sheet-supply rollers 7 may be rotated in the forward direction, i.e., sheet-supply direction, no friction forces are produced between the rollers 7 and the bottom surface 5*a*. Thus, the respective outer circumferential surfaces of the sheet-supply rollers 7 can be prevented from being excessively worn, and the rollers 7 can be prevented from being "locked" by the base pads 63 that are provided on the bottom surface 5*a* and are formed of the material (e.g., cork) having the high friction coefficient. Consequently the LF motor 42 can be prevented from being seized or stuck because of the application thereto of excessively large loads.

The above-described moving device 46 may be replaced with another moving device 56 as a second embodiment of the present invention that will be described below by reference to FIGS. 7A, 7B, 7C, and 8.

The moving device 56 includes an operative member 52, and a tension coil spring 53 as a sort of elastic member as another sort of biasing means. The operative member 52 includes two base end portions 52*a* that are connected to the lower end portion (i.e., the free end portion) of the sheet-supply arm member 6*a* such that the operative member 52 is pivotable upward and downward about the support axis member 47. The operative member 52 additionally includes an extending portion extending upstream from the base end portions 52*a* with respect to the sheet-supply direction in which each recording sheet P is supplied from the sheet-supply cassette 5. As shown in FIG. 7B, a detecting portion 49 that is provided on a lower surface of an upstream-side portion 52*c* of the operative member 52 contacts the uppermost one of the recording sheets P stacked on the bottom surface 5*a* of the sheet-supply cassette 5. When no recording sheet P is left on the bottom surface 5*a*, as shown in FIG. 7C, the detecting portion 49 moves into the receiving hole 50 formed through the thickness of the bottom plate or wall of the cassette 5.

Figure 7A:
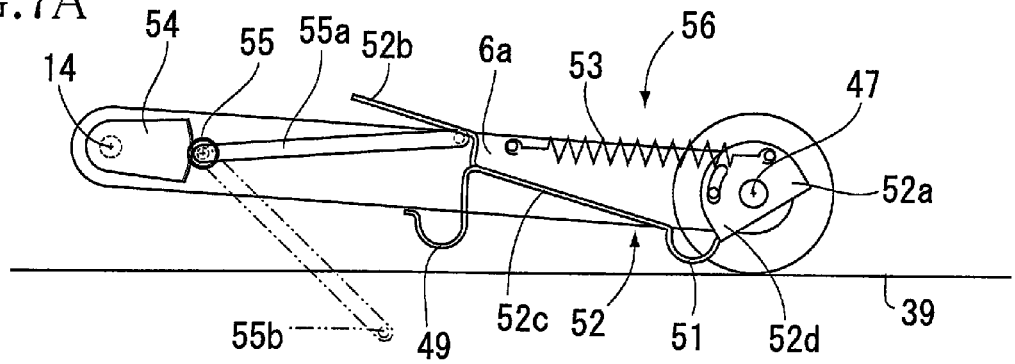
FIG. 7A is a side elevation view of another moving device as a second embodiment and a sheet-supply arm member in a state in which an operative member of the moving device and the sheet-supply arm member are positioned at respective retracted positions thereof.
Figure 7B:
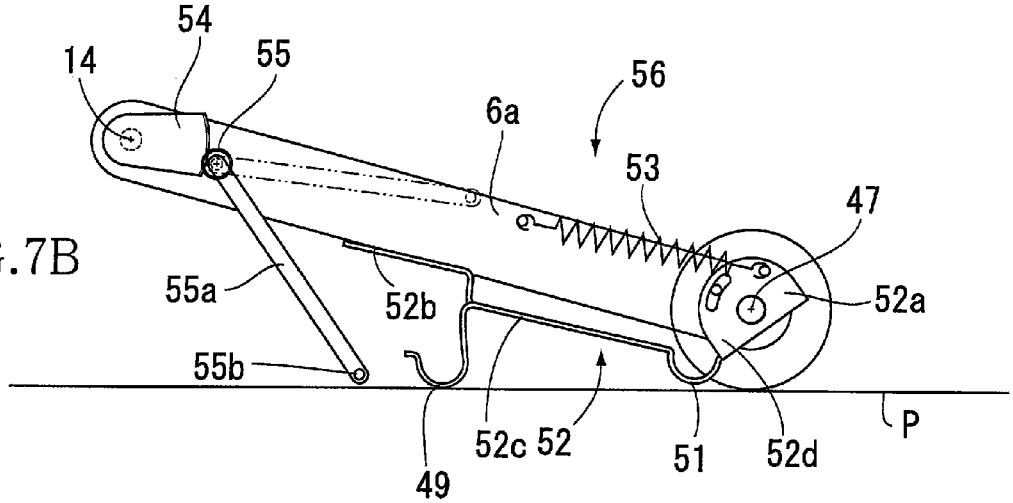
FIG. 7B is a side elevation view of the moving device of FIG. 7A and the sheet-supply arm member in a state in which at least one recording sheet P remains in a sheet-supply cassette.
Figure 7C:
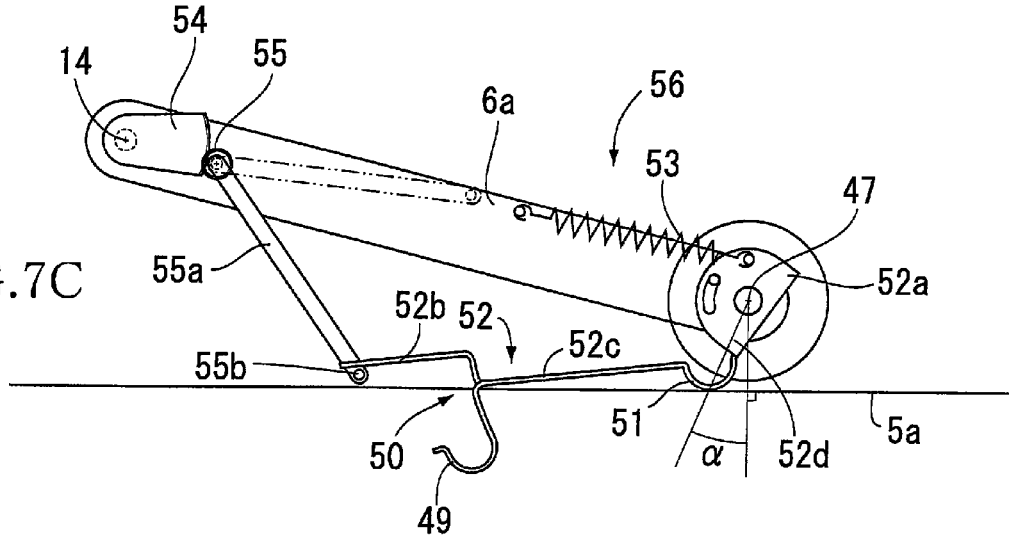
FIG. 7C is a side elevation view of the moving device of FIG. 7A and the sheet-supply arm member in a state in which no recording sheet P is left in the sheet-supply cassette.

FIG. 7A shows a state in which the arm member 6*a* and the operative member 52 are positioned at respective retracted positions thereof. When the sheet-supply cassette 5 is inserted into, or removed from, the main case 2, and the arm member 6*a* is pivoted upward about the drive axis member 14 by a cam and a cam follower, not shown, a pinion 55 that is rotatably supported by the arm member 6*a* and is meshed with a sector gear 54 as a stationary gear fixed to the engine frame 39, is rotated and moved upward relative to the sector gear 54 while being meshed with the same 54. Therefore, an arm 55*a* fixed to one axial end of the pinion 55 is pivoted upward about an axis line of rotation of the pinion 55, and a pin 55*b* fixed to a downstream-side end of the arm 55*a* moves an upstream-side end portion 52*b* of the operative member 52 to a retracted position of the same 52. Thus, the sector gear 54, the pinion 55, and the arm 55*a* cooperate with each other to provide the retracting device which retracts the operative member 52 to the retracted position thereof, or the retraction-movement converting device which converts the pivotal movement of the sheet-supply arm member 6*a* to the retracted position thereof, into the pivotal movement of the operative member 52 to the retracted position thereof.

The tension coil spring 53 is disposed such that when the detecting portion 49 moves into the receiving hole 50, the coil spring 53 operates for pivoting the operative member 52 about the fulcrum portion 51, thereby pivoting the arm member 6*a* upward, and thereby moving the sheet-supply rollers 7 upward apart from the bottom surface 5*a* of the sheet-supply cassette 5. In the present embodiment, one end of the tension coil spring 53 is fixed to the arm member 6*a*, and the other end of the coil spring 53 is fixed to one of the base end portions 52*a* of the operative member 52, as shown in FIG. 7A.

Figure 8:
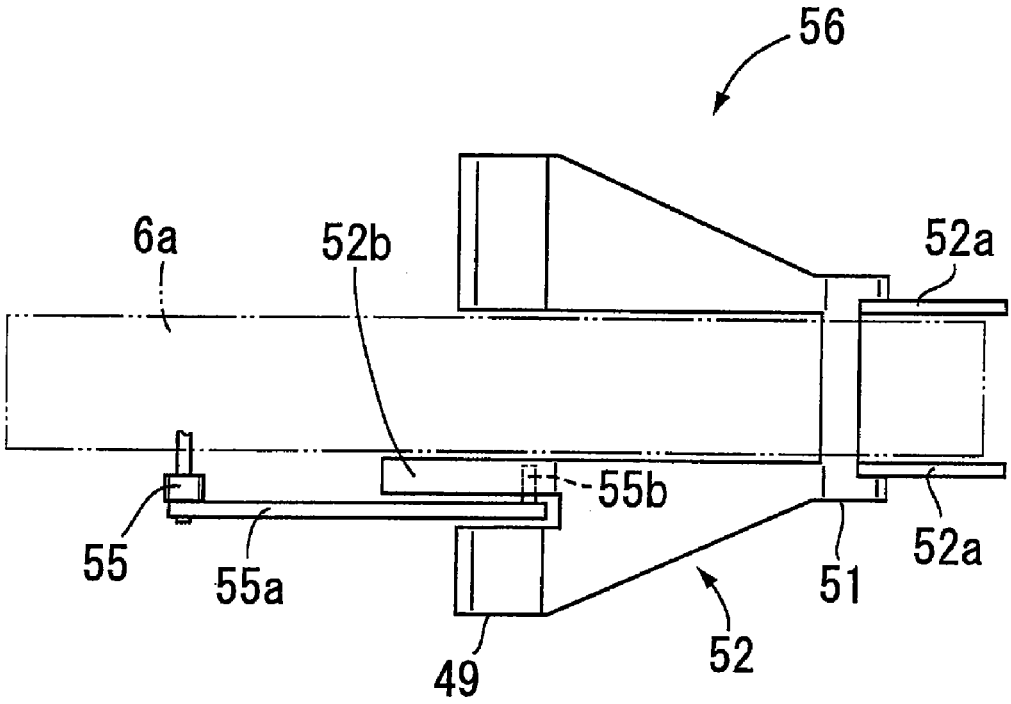
FIG. 8 is a plan view of an operative member of FIG. 7A.
Figure 9:
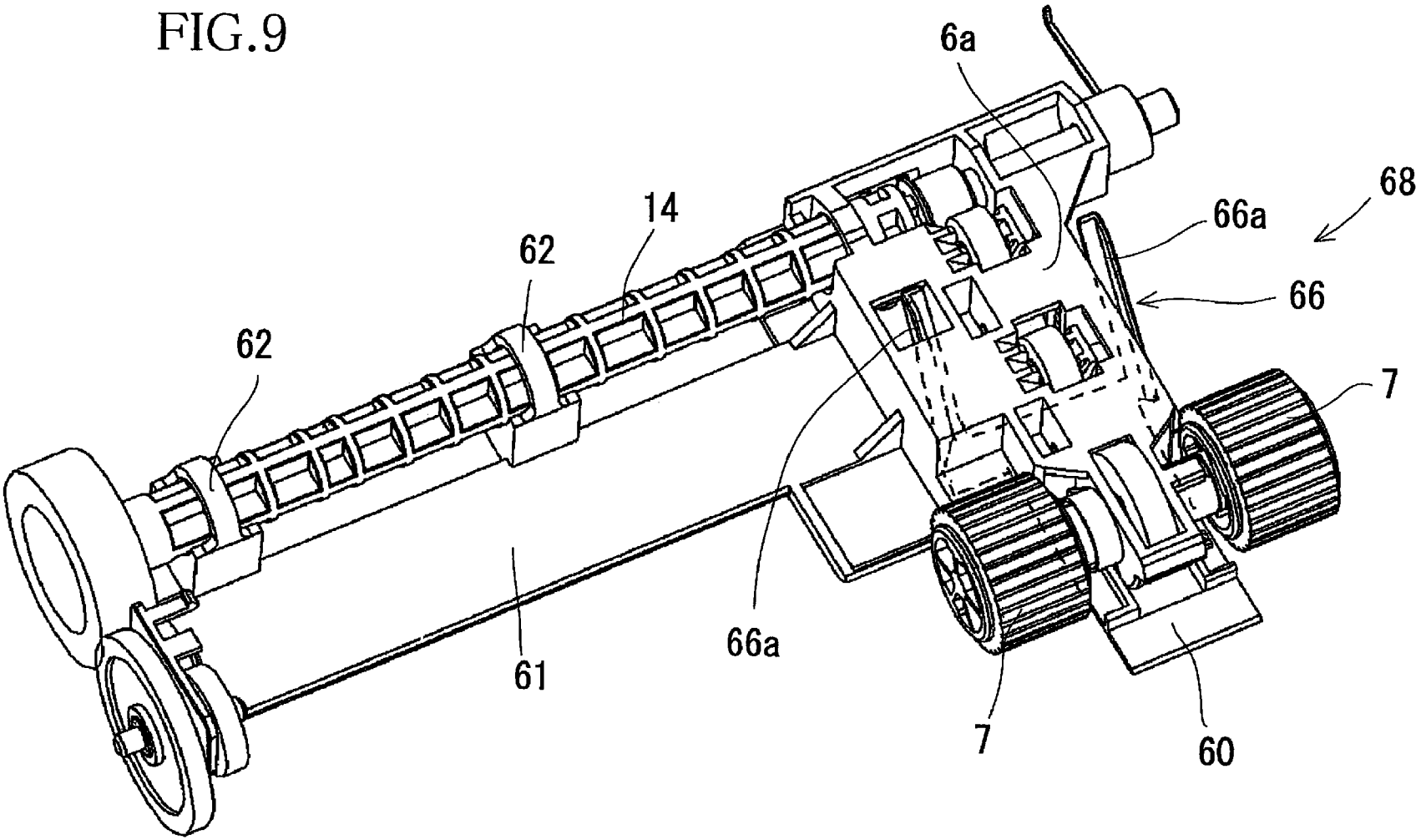
FIG. 9 is a perspective top view of another moving device of another image recording apparatus as a third embodiment, a sheet-supply arm member, and a retracting device.

In the present embodiment, the operative member 52 is formed of a resin plate, and has a generally flat shape as shown in FIGS. 7A and 8. The two base end portions 52*a* of the operative member 52 include respective flange portions (i.e., pivotal portions) which are provided on either side of the arm member 6*a* and each of which pivotably fits on a portion of the support axis member 47 that is located between the lower end portion of the arm member 6*a* and a corresponding one of the two sheet-supply rollers 7. A portion of the operative member 52 that is located below the arm member 6*a* has a width greater than that of the same 6*a*, as shown in FIG. 8. Each of the detecting portion 49 and the fulcrum portion 51 is elongate as shown in FIG. 8, and has a part-cylindrical outer surface as shown in FIG. 7A. Thus, a friction produced between the outer surface of each of the detecting portion 49 and the fulcrum portion 51 and the upper surface of each recording sheet P is minimized. In addition, preferably, a sheet having a low friction coefficient is adhered to the outer surface of each of the detecting portion 49 and the fulcrum portion 51. Alternatively, the outer surface of each of the detecting portion 49 and the fulcrum portion 51 may be formed of a material having a low friction coefficient. The base end portions 52*a* of the operative member 52 may be pivotally connected to an appropriate portion of the arm member 6*a* other than the support axis member 47, such that the operative member 52 is swingable upward and downward. The fulcrum portion 51 may be provided by one or more rollers that are rotatably supported by the operative member 52.

Preferably, an angle $\alpha$ (FIG. 7C) contained by (a) the downstream-side portion 52*d* of the operative member 52, i.e., a plane containing the fulcrum portion 51 and the support axis member 47, and (b) a vertical plane containing the support axis member 47 and extending perpendicularly to the bottom surface 5*a* is smaller than 45 degrees. In addition, a ratio of a length (as measured in the sheet-supply direction) of the upstream-side portion 52*c* (of the extending portion 52*c*, 52*d*) between the detecting portion 49 and the fulcrum portion 51, to a length (as measured in the same direction) of the downstream-side portion 52*d* (of the extending portion 52*c*, 52*d*) between the fulcrum portion 51 and the base end portions 52*a* or the support axis member 47 falls in a range of from 5 to 15, more preferably, from 8 to 12. The sheet-supply direction is parallel to the bottom surface 5*a*.

In the present embodiment, in a state in which a plurality of stacked recording sheets P are accommodated in the sheet-supply cassette 5, as shown in FIG. 7B, an angle of inclination of the arm member 6*a*, biased downward by the torsion spring 6*b*, with respect to the horizontal, bottom surface 5*a* is considerably small, and the sheet-supply rollers 7 are pressed, with an appropriate force, on the uppermost one of the recording sheets P. In this state, the pin 55*b* fixed to the arm 55*a* is positioned away from the operative member 52, and the operative member 52 is pressed downward by the biasing force of the tension coil spring 53, so that the detecting portion 49 provided on the upstream-side portion 52*c* of the operative member 52 is pressed on the uppermost recording sheet P. The state shown in FIG. 7B continues till the last recording sheet P is left on the bottom surface 5*a* of the sheet-supply cassette 5 and, when the last recording sheet P is supplied by the sheet-supply rollers 7 and the receiving hole 50 formed in the bottom surface 5*a* is opened, the detecting portion 49 of the operative member 52 moves into the receiving hole 50. Consequently the operative member 52 is pivoted about the fulcrum portion 51, so that the base end portions 52*a* of the operative member 52 are moved upward, the arm member 6*a* is moved upward, and the sheet-supply rollers 7 are moved upward apart from the bottom surface 5*a* by an appropriate distance, as shown in FIG. 7C.

Thus, even if the sheet-supply rollers 7 may be rotated in the forward direction, no friction forces are produced between the rollers 7 and the bottom surface 5*a*. Therefore, the respective outer circumferential surfaces of the sheet-supply rollers 7 can be prevented from being excessively worn, and the rollers 7 can be prevented from being "locked" by the base pads 63 that are provided on the upper surface of the bottom plate 5*a* and are formed of the material (e.g., cork) having the high friction coefficient. Consequently the LF motor 42 can be prevented from being seized or stuck because of the application thereto of excessively large loads.

Figure 10:
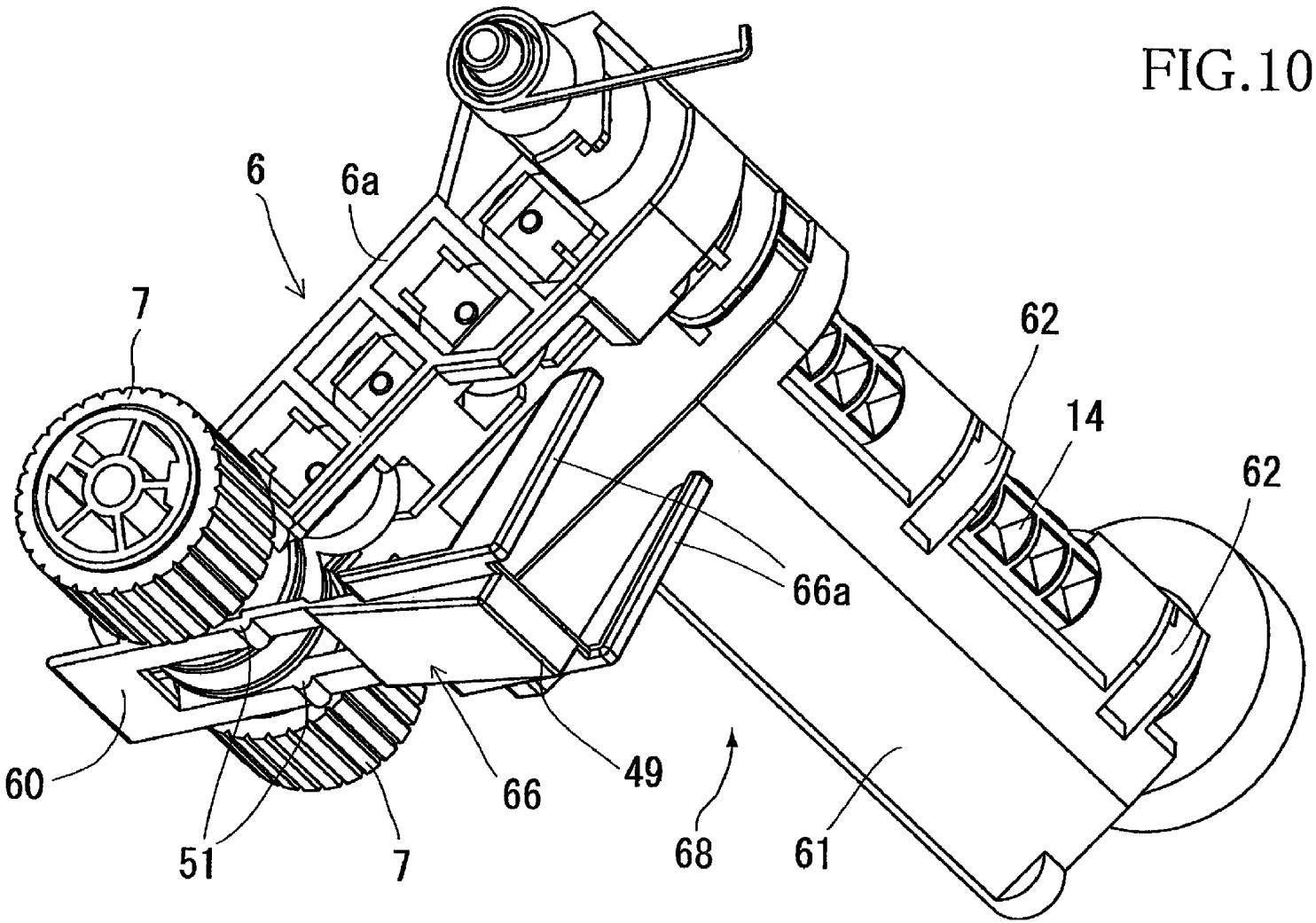
FIG. 10 is a perspective bottom view of the moving device of FIG. 9, the sheet-supply arm member, and the retracting device.
Figure 11:
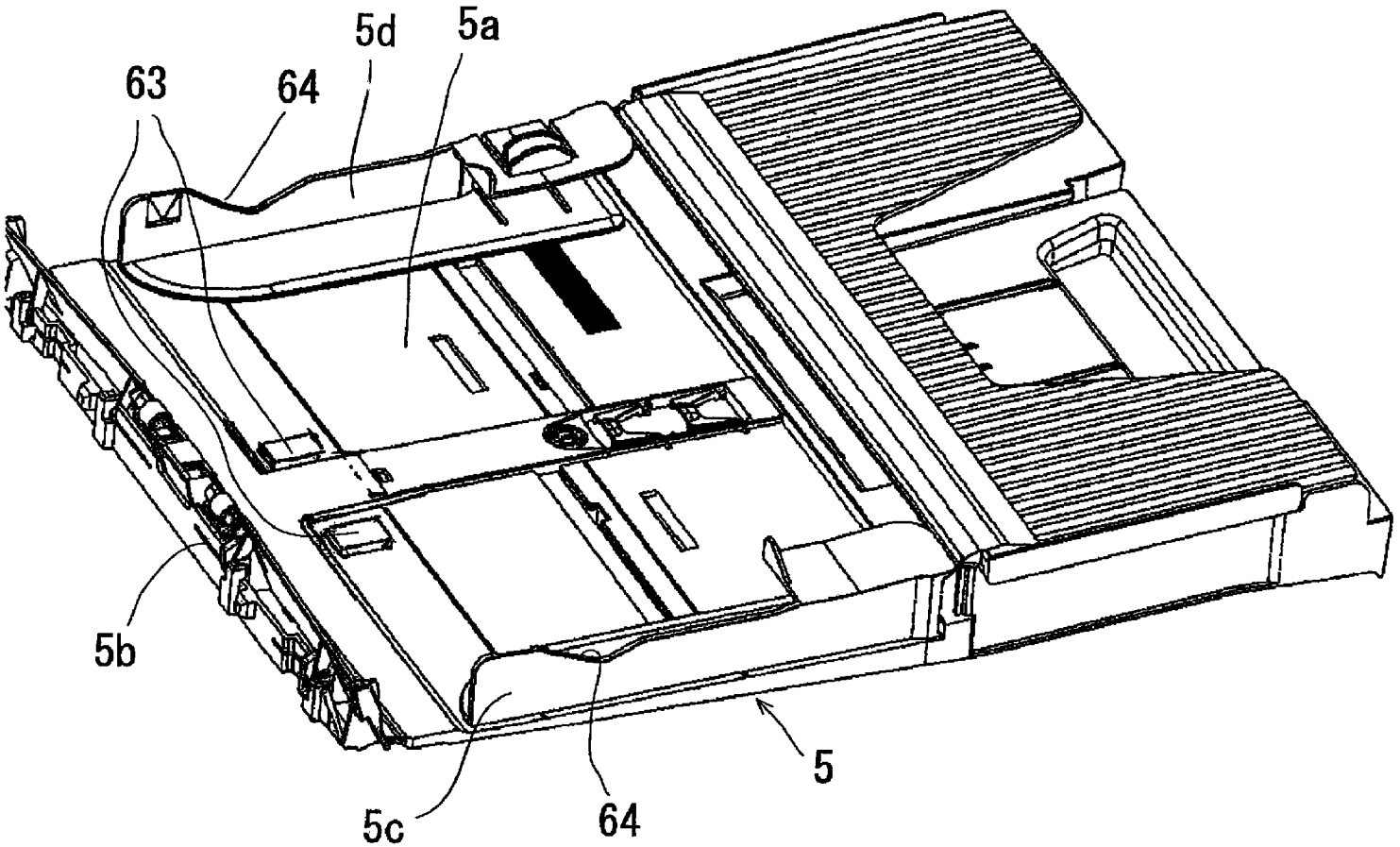
FIG. 11 is a perspective view of a sheet-supply cassette including a portion of the retracting device.
Figure 12:
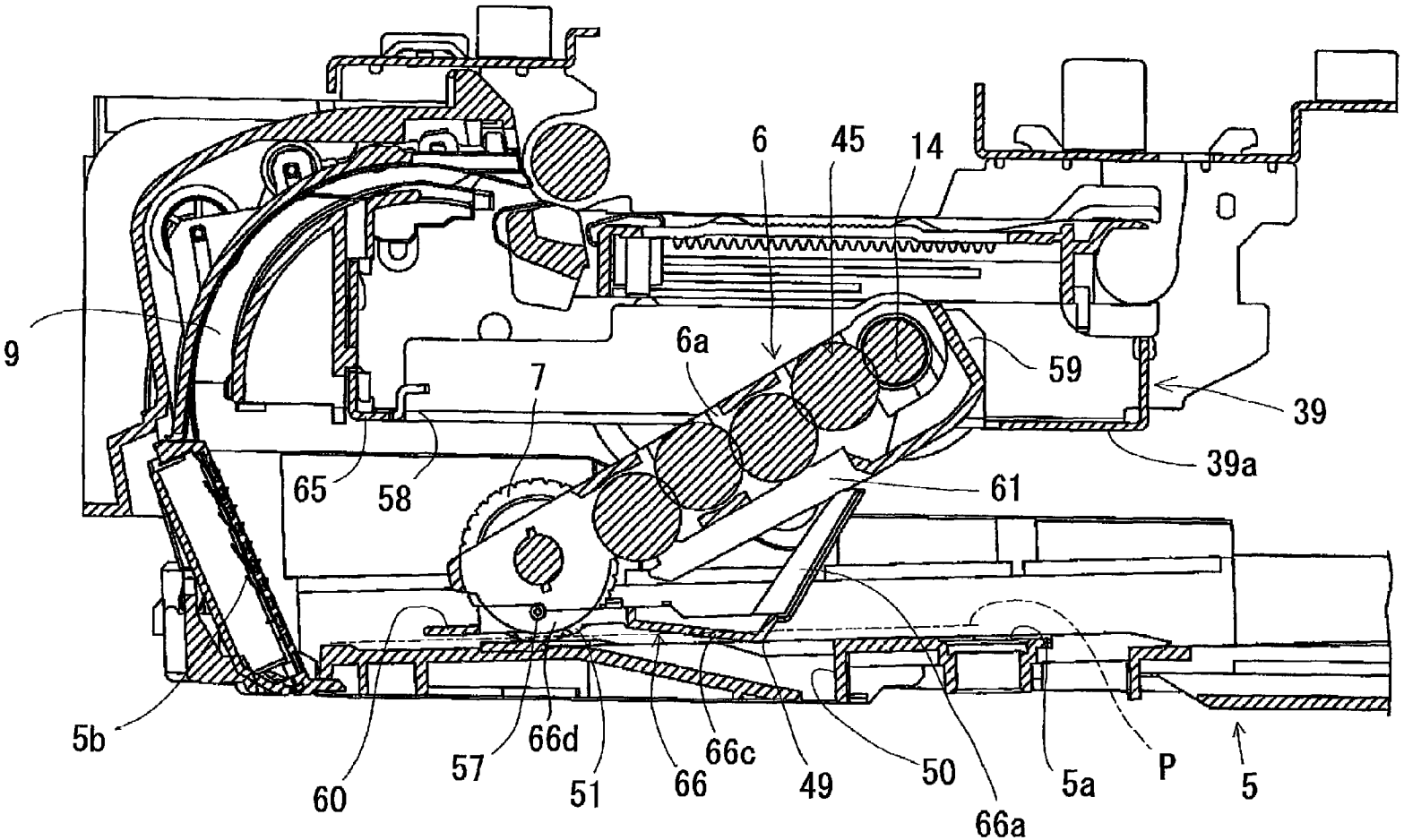
FIG. 12 is a view for explaining an operation of the moving device of FIG. 9 in a state in which only one recording sheet P remains in the sheet-supply cassette.

FIGS. 9 through 15 shows a third embodiment of the present invention that is a modified form of the first embodiment shown in FIGS. 1 through 4, 5A through 5C, and 6. The present image recording apparatus employs another moving device 68 including an operative member 66, and a retracting device that retracts, when the sheet-supply cassette 5 is inserted to, and removed from, the main case 2, in substantially horizontal directions, the operative member 66 and the sheet-supply unit 6 (i.e., the sheet-supply arm member 6*a* and the sheet-supply rollers 7) to their retracted positions, so as not to interfere with the downstream-side end portion 5*b* (i.e., the inclined sheet-separate plate) of the cassette 5. The engine frame 39 includes, as the main portion thereof, a bottom plate 39*a* having a receiving opening 58 that receives the arm member 6*a* of the sheet-supply unit 6, when the arm member 6*a* is pivoted upward to its retracted position. The drive axis member 14 that extends in the direction perpendicular to the sheet-supply direction in which each recording sheet P is supplied from the sheet-supply cassette 5 is rotatably supported by a support bracket 59 provided on an upper surface of the bottom plate 39*a*, as shown in FIG. 12.

As shown in FIGS. 9, 10, and 12 through 14, the operative member 66 has, in its side view, a generally V-shaped configuration. Two base end portions of the operative member 66 are connected to two axis portions 57 that extend outward from opposite side surfaces of the arm member 6*a*, respectively, such that the operative member 66 is pivotable upward and downward about the axis portions 57. An extending portion of the operative member 66 that is located on an upstream side of the axis portions 57 with respect to the direction of supplying of recording sheet P includes an upstream-side portion 66*c* located between a fulcrum portion 51 and a detecting portion 49; a downstream-side portion 66*d* located between the axis portions 57 and the fulcrum portion 51; and a bifurcated, obliquely upward projecting portion 66*a* that has an increased weight. The detecting portion 49 is provided on a lower surface of the upstream-side portion 66*c* of the operative member 66, and the fulcrum portion 51 projects downward from the lower surface of the extending portion of the operative member 66, at a position between the detecting portion 49 and the axis portions 57.

Like the first embodiment, the third embodiment is adapted such that when no recording sheet P remains on the bottom surface 5*a* of the sheet-supply cassette 5, the detecting portion 49 moves into the receiving hole 50 formed in the bottom surface 5*a*. In the present embodiment, the receiving hole 50 includes a large recessed portion and a small through-hole, as shown in FIG. 12. In addition, when the detecting portion 49 moves into the receiving hole 50, the fulcrum portion 51 contacts the bottom surface 5*a* of the sheet-supply cassette 5, so that the operative member 66 is pivoted about the fulcrum portion 51 and the sheet-supply rollers 7 are moved upward apart from the bottom surface 5*a*. As shown in FIGS. 9, 10, and 12 through 14, the operative member 66 additionally has, in a downstream-side end portion thereof, an engaging portion 60 that engages, when the arm member 6*a* is pivoted upward to its retracted position and almost all portions of the member 6*a* are received by the receiving opening 58, the lower surface of the engaging portion 65 of the engine frame 39.

In the third embodiment, as shown in FIG. 12, in a state in which a plurality of stacked recording sheets P are accommodated in the sheet-supply cassette 5, the sheet-supply rollers 7 are pressed on the uppermost one of the recording sheets P.

Since the operative member 66 is freely pivotable relative to the arm member 6*a*, the detecting portion 49 of the operative member 66 contacts the uppermost recording sheet P, but the fulcrum portion 51 is kept apart from the upper most recording sheet P by an appropriate distance. In this state, if a sheet-supply command is produced and the drive axis member 14 is rotated in the forward direction, the sheet-supply rollers 7 are rotated clockwise in FIG. 12 via the gear transmission device 45, so that the leading end of the recording sheet P engages the sheet-separate plate provided at the downstream-side end 5*b* (i.e., a left-hand end as seen in FIG. 12) of the sheet-supply cassette 5. The sheet-separate plate has, in a central portion thereof as seen in the widthwise direction of recording sheet P, an elastic sheet-separate pad (e.g., a leaf spring) as a sheet-separate member that separates only the uppermost recording sheet P from the other recording sheet(s) P, and helps the sheet-supply rollers 7 to supply the uppermost recording sheet P toward the image recording unit 10 along the sheet-feed path including the U-turn portion 9. This state continues till the last recording sheet P is left on the bottom surface 5*a* of the sheet-supply cassette 5.

Figure 13:
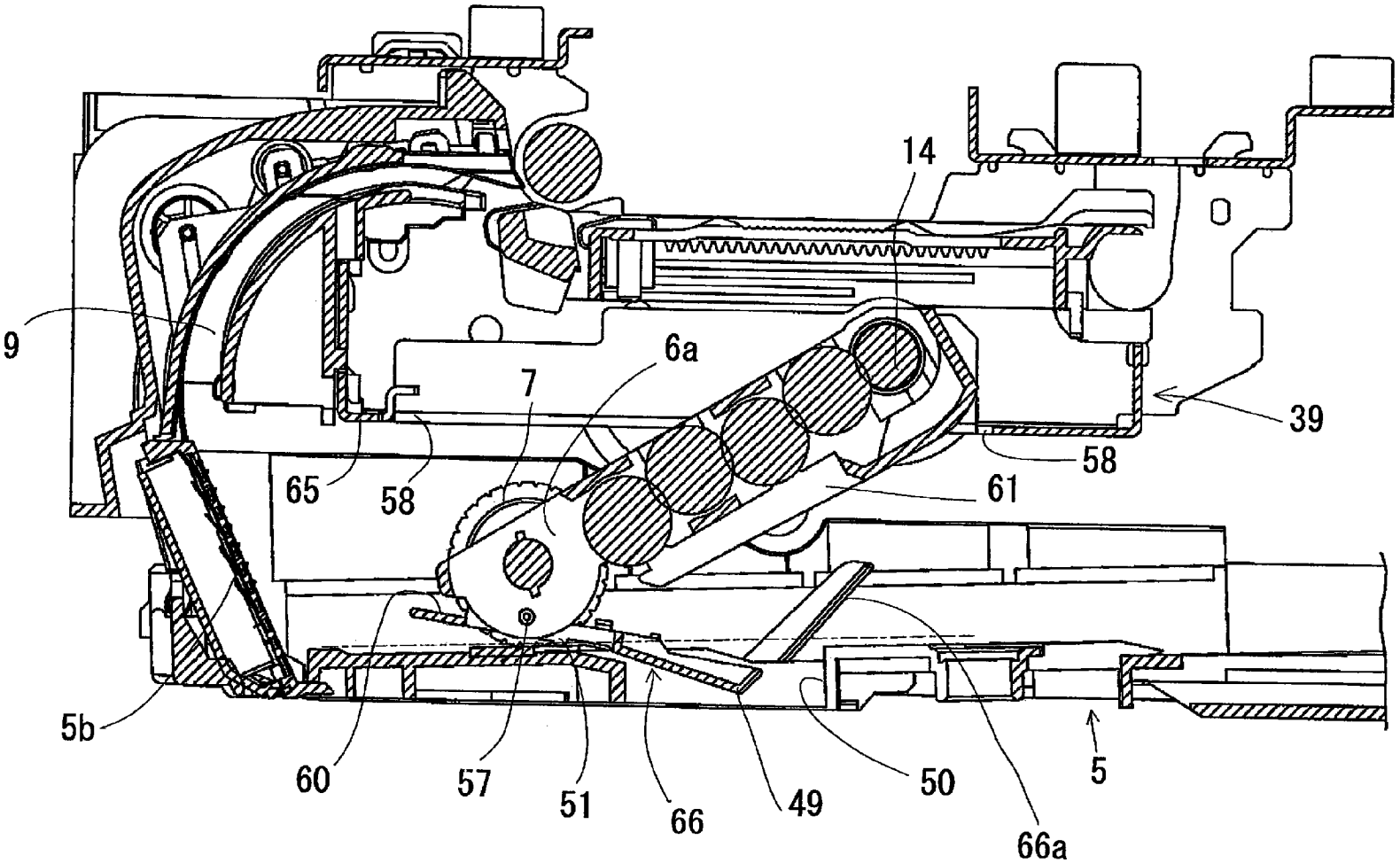
FIG. 13 is a view for explaining an operation of the moving device of FIG. 9 in a state in which no recording sheet P remains in the sheet-supply cassette.

Subsequently, when the last recording sheet P is supplied from the sheet-supply cassette 5, i.e., no recording sheet P is left on the bottom plate 5*a*, and the receiving hole 50 of the bottom surface 5*a* is opened, the detecting portion 49 of the operative member 66 moves into the receiving hole 50, and the fulcrum portion 51 provided in the intermediate portion of the operative member 66 contacts the bottom surface 5*a*, the operative member 56 is pivoted about the fulcrum portion 51, owing to the sum of the respective weights of the upstream-side portion 66*c* of the operative member 66 and the detecting portion 49, so that the arm member 6*a* is pivoted upward and the sheet-supply rollers 7 are moved upward apart from the bottom surface 5*a* by an appropriate distance, as shown in FIG. 13. Therefore, even if the sheet-supply rollers 7 may be rotated in the forward direction, no friction forces are produced between the rollers 7 and the bottom surface 5*a*. Thus, the respective outer circumferential surfaces of the sheet-supply rollers 7 can be prevented from being excessively worn, and the rollers 7 can be prevented from being "locked" by the base pads 63 (FIG. 11) that are provided on the bottom surface 5*a* and are formed of the material (e.g., cork) having the high friction coefficient. Consequently the LF motor 42 can be prevented from being seized or stuck because of the application thereto of excessively large loads.

As shown in FIG. 10, a wing 61 as a cam follower is formed as an integral portion of the arm member 6*a*, such that the wing 61 extends from one of opposite sides of the arm member 6*a*, parallel to the axis line of the drive axis member 14. The wing 61 has a plurality of ring portions 62 that are supported by the drive axis member 14 such that the wing 61 is pivotable with the arm member 6*a* about the axis member 14.

In addition, as shown in FIG. 11, two side plates 5*c*, 5*d* of the sheet-supply cassette 5 have, in respective upper surfaces thereof, respective cam surfaces 64 the height of each of which changes in the direction in which the cassette 5 is inserted to, and removed from, the main case 2. The cam surface 64 of the side plate 5*d* as a cam, the wing 61 as the cam follower, the engaging portion 60 of the operative member 56, and the engaging portion 65 of the engine frame 39 cooperate with each other to provide the above-indicated retracting device. In particular, the cam surface 64 of the side plate 5*d* and the wing 61 as the cam follower cooperate with each other to provide a first retracting device that retracts the arm member 6*a* to its retracted position; and the engaging portion 60 of the operative member 56 and the engaging portion 65 of the engine frame 39 cooperate with each other to provide a second retracting device that retracts the operative member 56 to its retracted position, or the retraction-movement converting device that converts the pivotal movement of the arm member 6*a* about the drive axis member 14, into the pivotal movement of the operative member 56 about the axis portions 57 to its retracted position.

Figure 14:
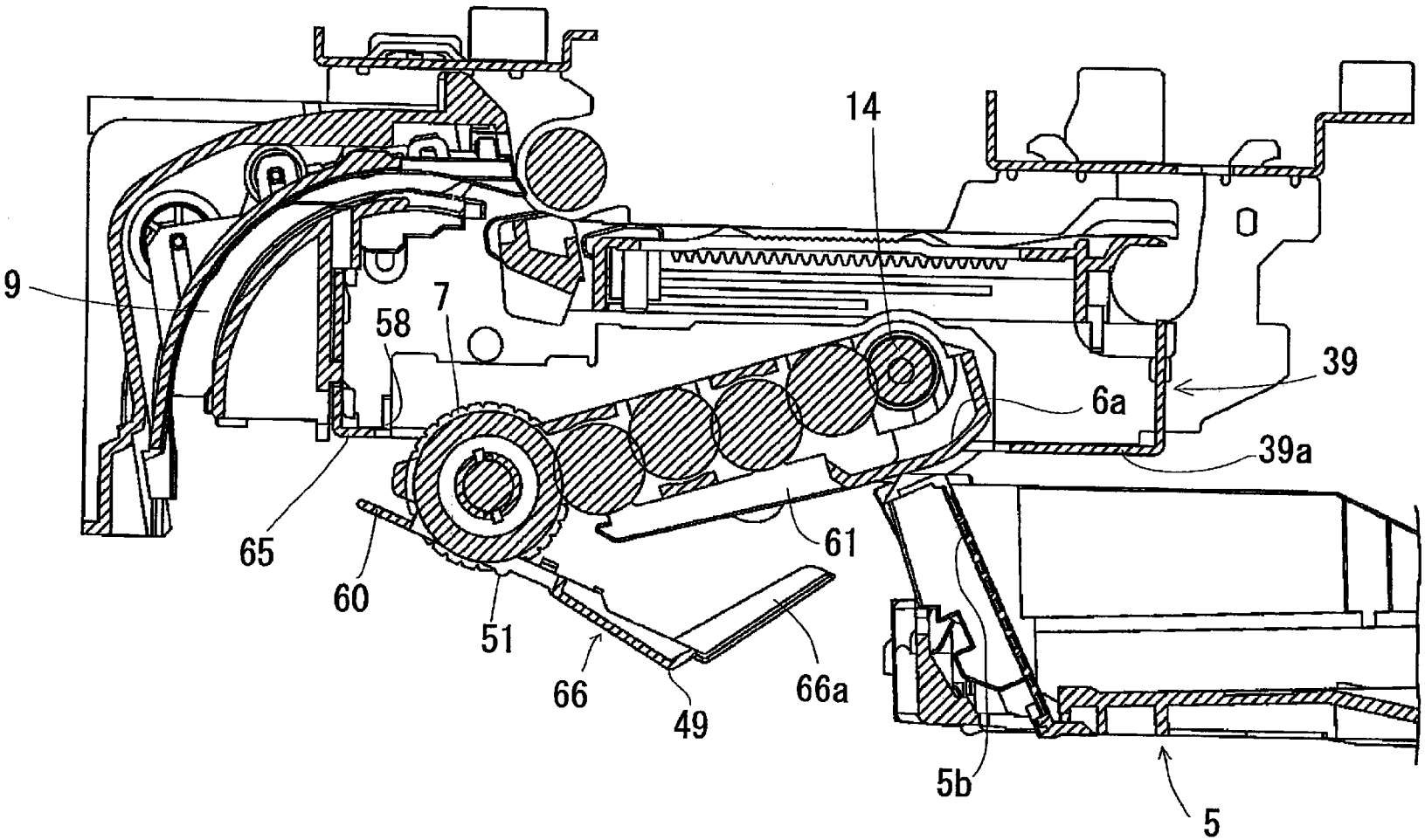
FIG. 14 is a view for explaining respective movements of the moving device of FIG. 9 and the sheet-supply arm member when the sheet-supply cassette is inserted.
Figure 15:
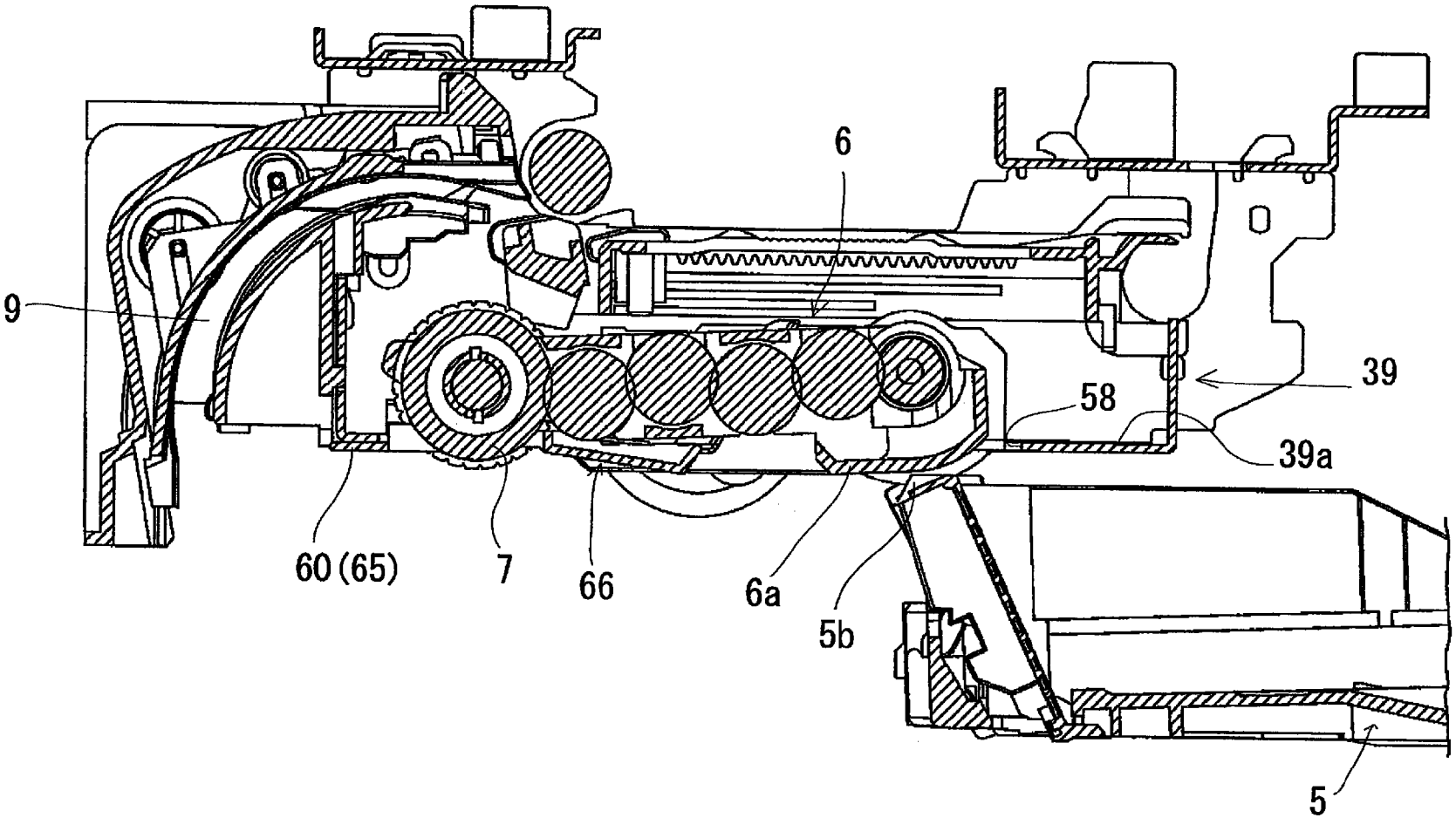
FIG. 15 is a view for explaining a state in which the moving device of FIG. 9 and the arm sheet-supply member are positioned at respective retracted positions thereof.
Figure 16:
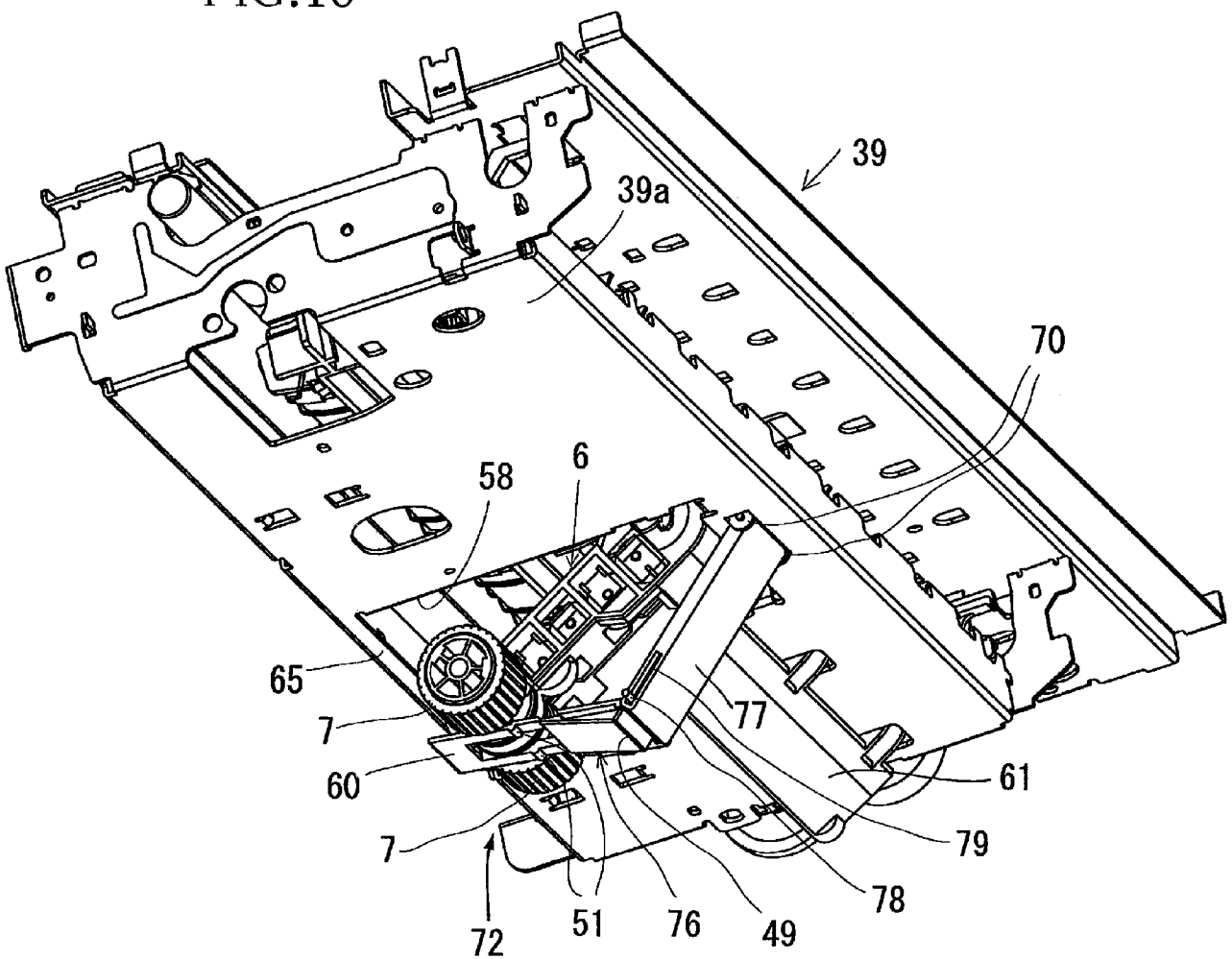
FIG. 16 is a perspective bottom view of another moving device of another image recording apparatus as a fourth embodiment of the present invention.

Thus, as shown in FIG. 14, when the sheet-supply cassette 5 is inserted to, and removed from, the main case 2, an upper end of the downstream-side end portion 5*b* of the sheet-supply cassette 5 pushes upward the arm member 6*a* and the wing 61. Consequently the operative member 66 is moved upward together with the arm member 6*a*. However, at an early stage, the operative member 66 is inclined such that the engaging portion 60 is higher than the bifurcated portion 66*a*, because the bifurcated portion 66*a* is heavier than the engaging portion 60. When almost all portions of the arm member 6*a* are received by the receiving opening 58 formed through the thickness of the bottom plate 39*a* of the engine frame 39, the engaging portion 60 of the operative member 66 engages the lower surface of the engaging portion 65 as a portion of the bottom plate 39*a*. Subsequently, as the arm member 6*a* is pivoted upward, the operative member 66 is rotated about the axis portions 57, so that the bifurcated portion 66*a* is moved upward to its retracted position, as shown in FIG. 15.

In this way, the operative member 66 and the sheet-supply rollers 7 of the sheet-supply unit 6 climb over the upper end of the downstream-side end portion 5*b* of the sheet-supply cassette 5, without interfering with the same, and are positioned above the cassette 5. Subsequently, the wing 61 as the cam follower is guided by the cam surface 64 of the sheet-supply cassette 5 and, in a state in which the wing 61 is engaged with a low portion of the cam surface 64, the operative member 66 and the arm member 6*a* (or the sheet-supply rollers 7) are lowered and positioned near the bottom surface 5*a* of the cassette 5, as shown in FIG. 12.

When the sheet-supply cassette 5 is removed from the main case 2, the operative member 66 and the arm member 6*a* are moved upward and downward in the reverse order and can climb over the upper end of the downstream-side end portion 5*b* of the sheet-supply cassette 5, without interfering with the same.

FIGS. 16 through 19 show a fourth embodiment of the present invention. In the fourth embodiment, a moving device 72 includes a main operative member 76 and a secondary operative member 77. Like the operative member 66 employed in the third embodiment, the main operative member 76 is connected, at a base end portion thereof, to two axis portions 57 (FIG. 17) provided on opposite side surfaces of the arm member 6*a*, such that the main operative member 76 is pivotable about the axis portions 57. In addition, like the operative member 66, the main operative member 76 includes the detecting portion 49, the fulcrum portion 51, and the engaging portion 60. The fourth embodiment differs from the third embodiment in that the main operative member 76 includes, in place of the bifurcated end portion 66*a* provided adjacent the detecting portion 49 of the operative member 66, a sliding pin 78 that extends in an elongate hole 79 formed in a lower portion of the secondary operative member 77, and that the secondary operative member 77 is connected, at an upper end portion thereto, to two support flanges 70 provided on the bottom plate 39*a* of the engine frame 39, as shown in FIGS. 16 through 19. Like the third embodiment, the first retracting device includes the wing 61 as the cam follower that is integral with the arm member 6*a*, and the cam surfaces 64 formed as the respective upper surfaces of the two side plates 5*c*, 5*d* of the sheet-supply cassette 5.

An upstream-side portion of the main operative member 76 that is located on an upstream side of the fulcrum portion 51 with respect to the direction of supplying of recording sheet P and that includes the detecting portion 49; and the secondary operative member 77 have respective increased weights. Therefore, like the first and third embodiments, in a state in which a plurality of stacked recording sheets P are accommodated by the sheet-supply cassette 5, the sheet-supply rollers 7 and the detecting portion 49 contact the uppermost one of the recording sheets P, but the fulcrum portion 51 does not contact the uppermost sheet P. A lower end portion of the secondary operative member 77 can be said as a portion of the detecting portion 49.

Figure 18:
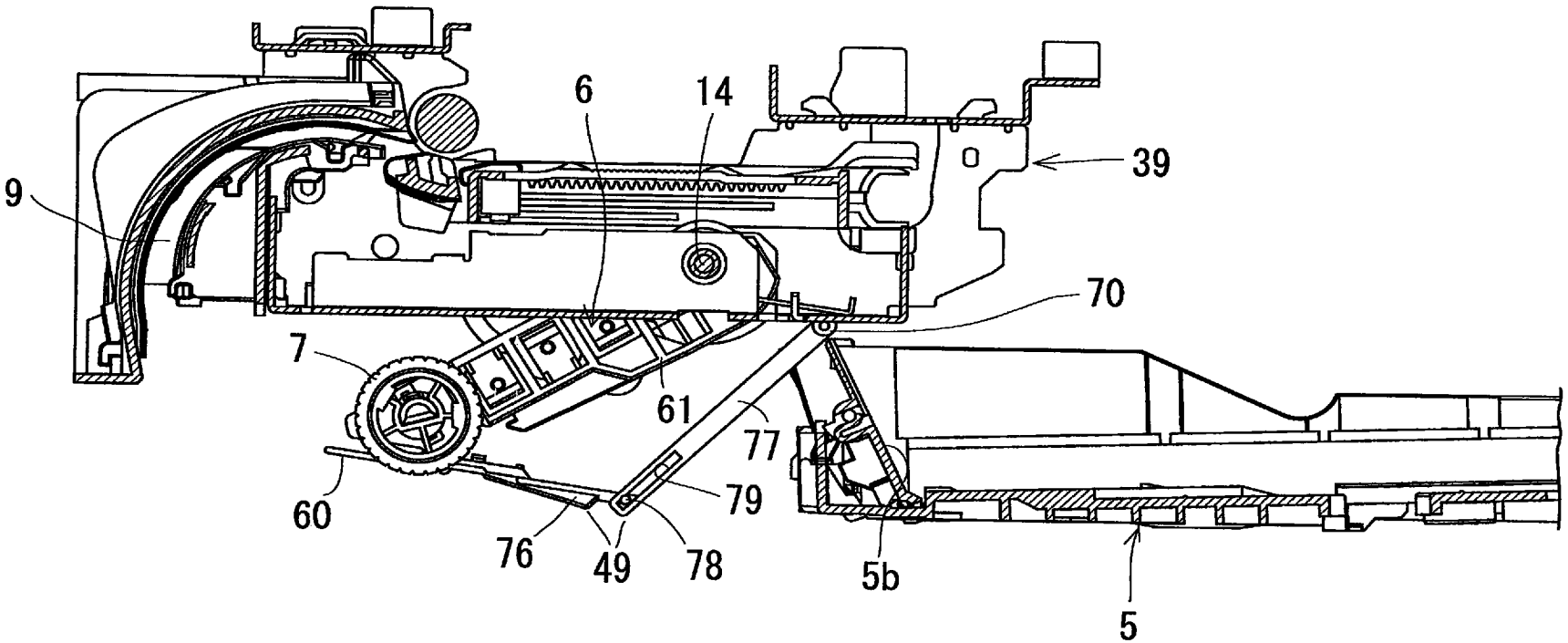
FIG. 18 is a side elevation view for explaining respective movements of the moving device of FIG. 16 and a sheet-supply arm member when the sheet-supply cassette is inserted.
Figure 19:
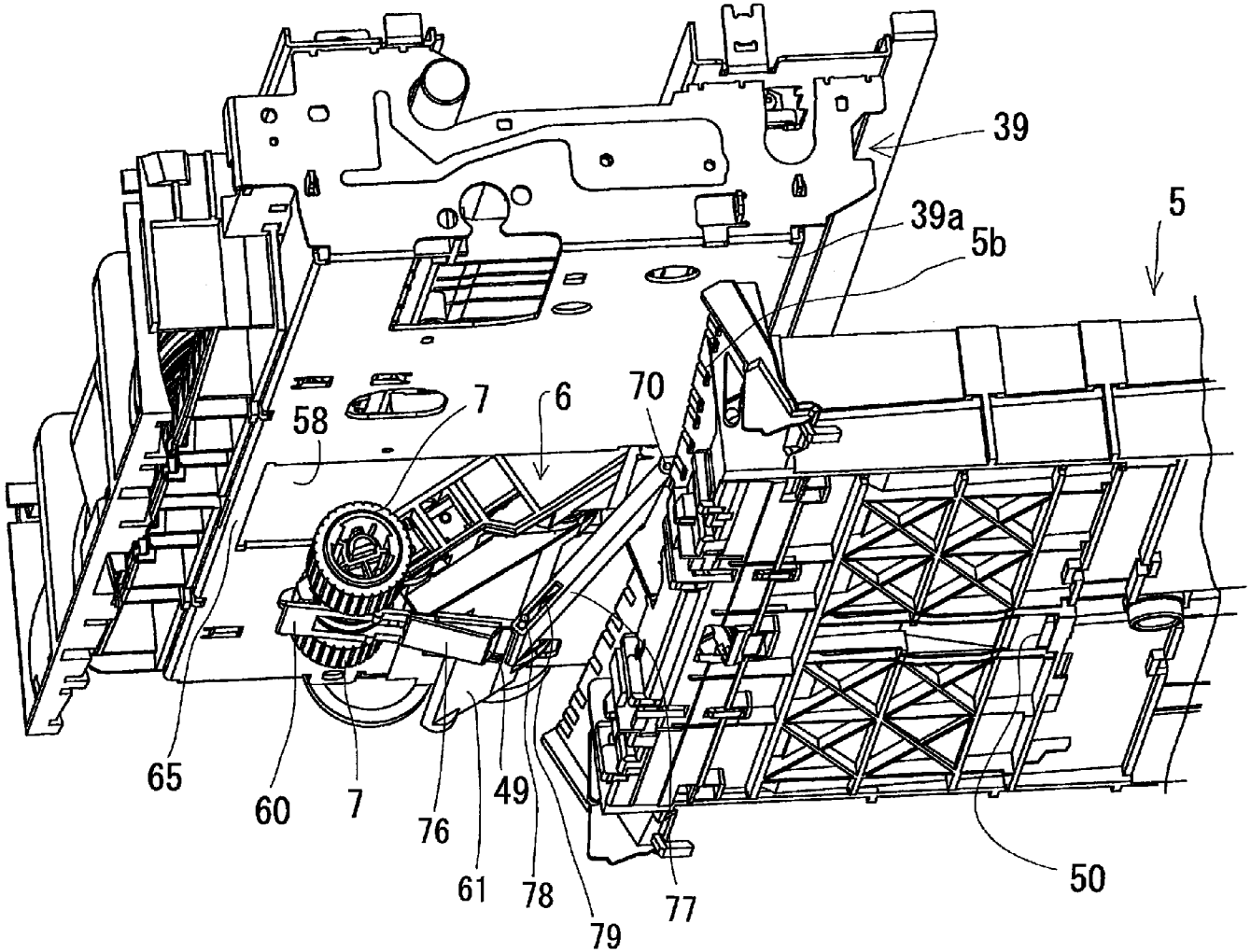
FIG. 19 is a perspective bottom view for explaining the respective movements of the moving device of FIG. 16 and the sheet-supply arm member when the sheet-supply cassette is inserted.

As shown in FIG. 18, when the sheet-supply cassette 5 is inserted into the main case 2 (FIG. 1), the upper end of the leading end portion 5*b* of the cassette 5 first pushes upward the secondary operative member 77. Since the secondary operative member 77 is connected to the main operative member 76 via the elongate hole 79 and the sliding pin 78, the upstream-side portion of the main operative member 76 that includes the detecting portion 49 is moved upward. Subsequently, the upper end of the leading end portion 5*b* engages the wing 61, so that the arm member 6*a* is also moved upward. Eventually, when almost all portions of the arm member 6*a* are received by the receiving opening 58 formed through the thickness of the bottom plate 39*a* of the engine frame 39, the engaging portion 60 as the downstream-side end portion of the main operative member 76 engages the lower surface of the engaging portion 65 as a portion of the bottom plate 39*a*. Then, as the arm member 6*a* is pivoted about the drive axis member 14, the main operative member 76 is also pivoted about the axis portions 57 such that the upstream-side portion of the main operative member 76 is moved upward.

In this way, the main operative member 76 and the sheet-supply rollers 7 of the sheet-supply unit 6 can be retracted to their retracted positions and be positioned above the sheet-supply cassette 5, so as not to interfere with the upper end of the leading end portion 5*b* of the cassette 5. Subsequently, the cam surface 64 of the side plate 5*d* of the cassette 5 is moved along the wing 61 as the cam follower and, in the state in which the wing 61 is engaged with a low portion of the cam surface 64, the main operative member 76, the secondary operative member 77, and the arm member 6*a* or the sheet-supply rollers 7 are lowered and positioned near the bottom surface 5*a* of the cassette 5, as shown in FIG. 17.

Figure 17:
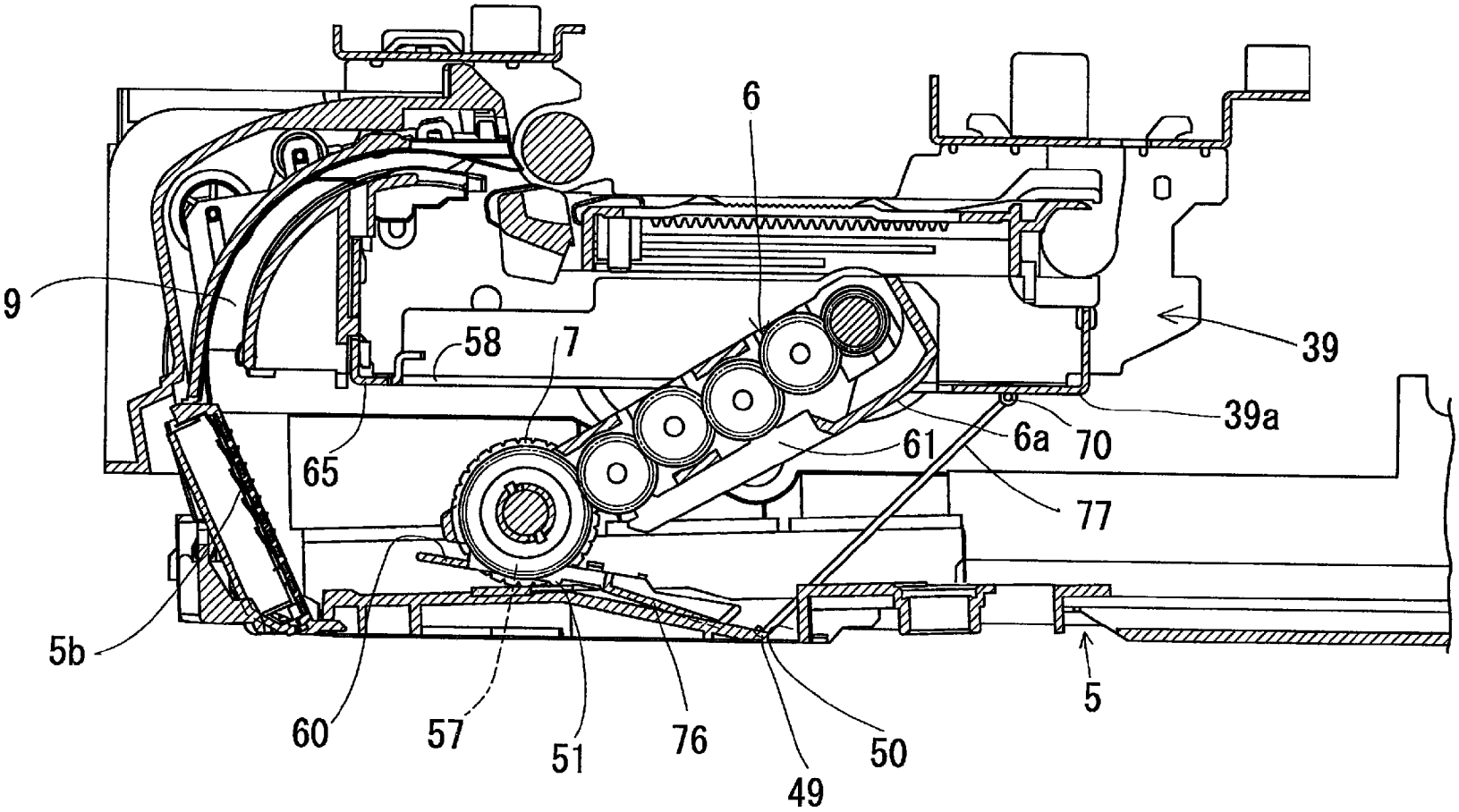
FIG. 17 is a view for explaining an operation of the moving device of FIG. 16 in a state in which no recording sheet P remains in a sheet-supply cassette.

When the sheet-supply cassette 5 is removed from the main case 2, the main operative member 76, the secondary operative member 77, and the arm member 6*a* are first moved upward owing to the movement of the cam surfaces 64 of the cassette 5 along the wing 61, so as not to interfere with the upper end of the currently trailing (i.e., previously leading) end portion 5*b* of the cassette 5, as shown in FIGS. 17 and 18. In the fourth embodiment, even in a state in which the sheet-supply cassette 5 is not present in the main case 2, an angle contained by the main operative member 76 and the secondary operative member 77 is prevented from being excessively decreased because the sliding pin 78 is engaged with the elongate hole 79. Thus, the upstream-side portion and the detecting portion 49 of the main operative member 76 are prevented from being excessively largely moved downward or hung down. Therefore, the sheet-supply cassette 5 can be smoothly inserted into, and removed from, the main case 2.

Like the inclined guide portion 48*b* as the upstream-side end portion of the operative member 48 employed in the first embodiment, the secondary operative member 77 employed in the first embodiment functions as a guide portion that easily guides or introduces respective leading ends of recording sheets P when those sheets P are inserted into the sheet-supply cassette 5.

Figure 20:
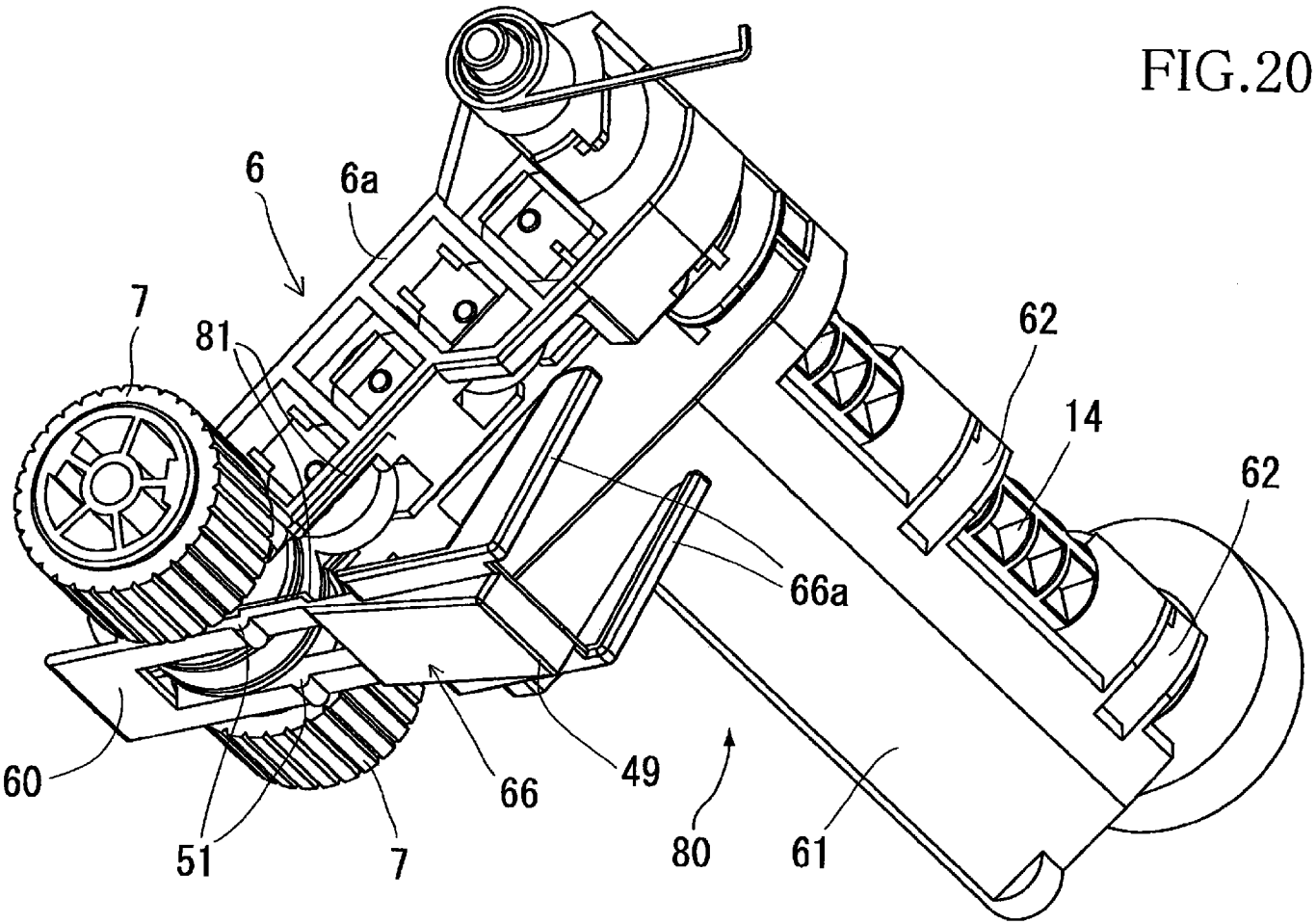
FIG. 20 is a view of another moving device as a fifth embodiment of the present invention, and a sheet-supply arm member.

FIG. 20 shows a modified form of the third embodiment shown in FIGS. 9 through 15. This modified form differs from the third embodiment only in that a moving device 80 additionally includes a torsion coil spring 81 as another sort of elastic member as the biasing means. The torsion coil spring 81 includes an intermediate coiled portion that movably fits around the support axis member 47, a first end portion that rests on the arm member 6*a*, and a second end portion that rests on the operative member 66. The torsion coil spring 81 biases the operative member 66 in a direction to increase an angle contained by the arm member 6*a* and the operative member 66. Therefore, when the trailing end of the last recording sheet P passes over the receiving hole 50 and the detecting portion 49 moves into the receiving hole 50, the torsion coil spring 81 cooperates with the respective weights of the detecting portion 49 and the upstream-side portion 66*c* of the operative member 66 to pivot the operative member 66 about the fulcrum portion 51 and thereby lift the sheet-supply rollers 7 upward away from the bottom surface 5*a* of the sheet-supply cassette 5.

While the present invention has been described in its preferred embodiments, it is to be understood that the present invention is by no means limited to the details of the described embodiments but may otherwise be embodied.

For example, in each of the illustrated embodiments, the image recording apparatus 1 employs the sheet-supply cassette 5 that is insertable into, and removable from, the main case 2 in the substantially horizontal directions. However, the principle of the present invention is applicable to such an image recording apparatus that employs, as a sheet accommodating portion, an inclined sheet supporting portion that is provided in a rear portion of a main case of the recording apparatus and has a plate-like configuration.

It is to be understood that the present invention may be embodied with various changes, modifications, and improvements that may occur to a person skilled in the art without departing from the spirit and scope of the invention defined in the appended claims.

What is claimed is:

1. A sheet supplying apparatus, comprising:

a sheet accommodating portion which has a support surface and which accommodates a plurality of stacked recording sheets including an uppermost recording sheet, such that the recording sheets are supported by the support surface;

a frame which supports the sheet accommodating portion;

a sheet supplying arm which is supported by the frame such that the sheet supplying arm is pivotable about a first axis line, and which is biased toward the support surface of the sheet accommodating portion;

at least one sheet supplying roller which is supported by an end portion of the sheet supplying arm such that said at least one sheet supplying roller is rotatable about a second axis line parallel to the first axis line, and which is pressed on the uppermost recording sheet, so that when said at least one sheet-supply roller is rotated, the uppermost recording sheet is supplied from the sheet accommodating portion;

a receiving portion which is provided in the support surface of the sheet accommodating portion and which is covered by the recording sheets and is opened when a trailing end of a last one of the recording sheets passes over the receiving portion; and a moving device including a detecting portion which is supported by the recording sheets and which moves, when the trailing end of the last recording sheet passes over the receiving portion, into the receiving portion and thereby detects the passing of the last recording sheet, and further including a detection-movement converting device which converts a movement of the detecting portion into the receiving portion, into a pivotal movement of the sheet supplying arm about the first axis line in a first direction to move said at least one sheet supplying roller away from the support surface of the sheet accommodating portion.

2. The sheet supplying apparatus according to claim 1, wherein the detection-movement converting device comprises an operative member and biasing means, wherein the operative member includes:

a base end portion which is connected to the sheet supplying arm such that the operative member is pivotable upward and downward about a third axis line;

an extending portion which extends from the base end portion in a direction having a component parallel to a second direction opposite to a third direction in which the uppermost recording sheet is supplied from the sheet accommodating portion;

the detecting portion which is provided on the extending portion of the operative member, which contacts an upper surface of the uppermost recording sheet, and which moves, when the trailing end of the last recording sheet passes over the receiving portion, into the receiving portion owing to a biasing force of the biasing means applied to the operative member; and a fulcrum portion which is provided on the operative member at a position between the detecting portion and the base end portion with respect to the third direction, and which contacts, when the detecting portion moves into the receiving portion, the last recording sheet or the support surface of the sheet accommodating portion, and wherein when the detecting portion moves into the receiving portion, the operative member is pivoted about the fulcrum portion so that the sheet supplying arm is pivoted about the first axis line in the first direction to move said at least one sheet supplying roller away from the support surface of the sheet accommodating portion.

3. The sheet supplying apparatus according to claim 2, wherein the biasing means comprises a weight of a portion of the operative member that is located on an upstream side of the fulcrum portion with respect to the third direction.

4. The sheet supplying apparatus according to claim 2, wherein the biasing means comprises an elastic member.

5. The sheet supplying apparatus according to claim 4, wherein the elastic member comprises a torsion coil spring.

6. The sheet supplying apparatus according to claim 4, wherein the elastic member comprises a tension coil spring.

7. The sheet supplying apparatus according to claim 2, where the third axis line coincides with the second axis line.

8. The sheet supplying apparatus according to claim 2, wherein a ratio of a first length in the third direction of a first portion of the operative member between the detecting portion and the fulcrum portion to a second length in the third direction of a second portion of the operative member between the fulcrum portion and the base end portion falls in a range of from 5 to 15.

9. The sheet supplying apparatus according to claim 1, further comprising a gear transmission device which is supported by the sheet supplying arm and which transmits a rotation of a driving source to said at least one sheet supplying roller, wherein the gear transmission device includes a planetary gear.

10. The sheet supplying apparatus according to claim 2, wherein the operative member further includes an inclined guide portion which is provided on an upstream side of the detecting portion with respect to the third direction and which guides respective leading ends of the recording sheets being inserted into the sheet accommodating portion.

11. The sheet supplying apparatus according to claim 2, wherein the sheet accommodating portion comprises a sheet-supply cassette which is insertable into, and is removable from, the frame, and wherein the apparatus further comprises a first retracting device which retracts, when the sheet-supply cassette is inserted into, and removed from, the frame, the sheet supplying arm to a retracted position thereof where the sheet supplying arm does not interfere with the sheet-supply cassette and the recording sheets accommodated thereby.

12. The sheet supplying apparatus according to claim 11, wherein the apparatus further comprises a second retracting device which retracts, when the sheet-supply cassette is inserted into, and removed from, the frame, the operative member to a retracted position thereof where the operative member does not interfere with the sheet-supply cassette and the recording sheets accommodated thereby, and wherein the second retracting device comprises a retraction-movement converting device which converts a retraction movement of the sheet supplying arm to the retracted position thereof into a retraction movement of the operative member to the retracted position thereof.

13. The sheet supplying apparatus according to claim 12, wherein the retraction-movement converting device comprises a first engagement portion of the operative member and a second engagement portion of the frame and, when the sheet supplying arm is retracted to the retracted position thereof, the first and second engagement portions engage with each other and thereby pivot the operative member about the base end portion thereof so as to retract the operative member to the retracted position thereof.

14. The sheet supplying apparatus according to claim 12, wherein the retraction-movement converting device comprises a stationary gear, a pinion which is meshed with the stationary gear, and an arm which supports the operative member, wherein the stationary gear is supported by the frame, the pinion is supported by the sheet supplying arm such that the pinion is rotatable about a fourth axis line, and the arm is fixed to the pinion and, when the sheet supplying arm is retracted to the retracted position thereof, the pinion is moved relative to the stationary gear while the pinion is rotated, and the arm is pivoted about the fourth axis line, so that the base end portion of the operative member supported by the pinion is pivoted about the third axis line and the operative member is retracted to the retracted position thereof.

15. The sheet supplying apparatus according to claim 2, wherein the sheet accommodating portion comprises a sheet-supply cassette which is insertable into, and is removable from, the frame, and wherein the apparatus further comprises a retracting device which retracts, when the sheet-supply cassette is inserted into, and removed from, the frame, the operative member to a retracted position thereof where the operative member does not interfere with the sheet-supply cassette and the recording sheets accommodated thereby.

16. An image recording apparatus, comprising:

the sheet supplying apparatus according to claim 1; and an image recording portion which records an image on each of the recording sheets supplied by the sheet supplying apparatus.

* * * * *